United States Patent [19]

Kubodera et al.

[11] Patent Number: 4,677,051

[45] Date of Patent: Jun. 30, 1987

[54] HEAT-DEVELOPMENT COLOR LIGHT-SENSITIVE MATERIAL

[75] Inventors: Seiiti Kubodera; Takanori Hioki; Masaki Okazaki, all of Minami-ashigara, Japan

[73] Assignee: Fuji Photo Film Co., Ltd., Kanagawa, Japan

[21] Appl. No.: 801,727

[22] Filed: Nov. 26, 1985

[30] Foreign Application Priority Data

Nov. 30, 1984 [JP] Japan ..... 59-253744

[51] Int. Cl.[4] ..... G03C 1/19; G03C 1/40

[52] U.S. Cl. ..... 430/550; 430/560; 430/617; 430/619; 430/620; 430/588; 430/351; 430/562; 430/203

[58] Field of Search ..... 420/588, 203, 619, 620, 420/560, 562, 559, 543, 548, 553, 557, 958, 617, 550, 351

[56] References Cited

U.S. PATENT DOCUMENTS

| | | | |
|---|---|---|---|
| 3,157,507 | 11/1964 | Bruengger et al. | 430/560 |
| 3,955,996 | 5/1976 | Hinata et al. | 430/588 |
| 4,499,180 | 2/1985 | Hirai et al. | 430/619 |
| 4,524,128 | 6/1985 | Edwards et al. | 430/619 |
| 4,584,267 | 4/1986 | Masukawa et al. | 430/620 |

*Primary Examiner*—Won H. Louie

*Attorney, Agent, or Firm*—Sughrue, Mion, Zinn, Macpeak, and Seas

[57] ABSTRACT

A heat-developable color light-sensitive material is provided comprising on a support at least a light-sensitive silver halide emulsion, a binder, a compound capable of producing or releasing a mobile dye in direct or inverse proportion to the reaction of the light-sensitive silver halide being reduced into silver at elevated temperatures, and a dye having the general formula:

wherein each of $R^1$ and $R^2$ is a substituted or unsubstituted alkyl or alkenyl group, $R^3$ is a hydrogen atom, or substituted or unsubstituted alkyl, alkoxy, aryl or alkenyl group, each of $X^1$, $X^2$, $X^3$, and $X^4$ is a hydrogen atom, halogen atom, hydroxyl, carboxyl, or substituted or unsubstituted alkyl, alkoxy, alkoxycarbonyl, acyl, acyloxyl, aryl, amino, or acylamino group, $X^1$ and $X^2$, and $X^3$ and $X^4$ can be mutually combined to form a benzene ring, $A^-$ is an anion, and n is equal to 0 or 1.

7 Claims, No Drawings

HEAT-DEVELOPMENT COLOR LIGHT-SENSITIVE MATERIAL

BACKGROUND OF THE INVENTION

This invention relates to a heat-developable color light-sensitive material, and more particularly, to a heat-developable color light-sensitive material having retarded sensitivity reduction.

The photographic process using silver halide has heretofore been most widely used because of its improved photographic properties such as sensitivity and gradation control as compared with other photographic processes including electrophotography and diazo process. Recently, an innovative technique was developed which succeeded in readily and fast producing an image in the image forming process of silver halide base light-sensitive materials by replacing the wet treatment using conventional liquid developer by a dry treatment by heating or other suitable means.

Heat-developable light-sensitive materials are well known in the art. The heat-developable light-sensitive materials and their process are described, among others, "Basic Photographic Engineering", Corona Sha (1979), pages 553–555; "Image Information" (April 1978), page 40; Nebletts Handbook of Photography and Reprography, 7th Ed. (Van Nostrand Reinhold Company), page 32; U.S. Pat. Nos. 3,152,904, 3,301,678, 3,392,020, and 3,457,075; British Pat. Nos. 1,131,108 and 1,167,777; and Research Disclosure, June 1978, pages 9–15 (RD-17029).

A number of proposals have also been made for producing color images through heat development. One exemplary method for forming color images through coupling of an oxidation product of a developing agent with a coupler and various developing agents used in such a method are disclosed in U.S. Pat. Nos. 3,531,286, 3,761,270, and 4,021,240, Belgian Pat. No. 802,519, and Research Disclosure, September 1975, pages 31–32.

Another heat developing method of incorporating a nitrogen-containing heterocyclic group into a dye to form a silver salt and causing the salt to release the dye through heat development is described in Research Disclosure, May 1978, pages 54–58 (RD-16966).

Also known is a method for forming positive color images by heat-sensitive silver dye bleaching process. For example, Research Disclosure, April 1976, pages 30–32 (RD-14433), idid., December 1976, pages 14–15 (RD-15227), and U.S. Pat. No. 4,235,957 describe useful dye bleaching processes.

Formation of color images using leuco dyes is described in, for example, U.S. Pat. Nos. 3,985,565 and 4,022,617.

These color image producing methods, however, are not satisfactory for an extended period of storage in that color image produced thereby tends to discolor with white areas being colored due to the coexisting silver halide, silver complex, developing agent and the like. To mitigate such an undesirable phenomenon, a number of processes for producing color images through heat development are proposed as diclosed in Japanese patent application Kokai Nos. 57-179840, 57-186774, 57-198458, 57-207250, 58-58543, 58-79247, 58-116537, 58-149046, 59-48764, 59-65839, 59-71046, 59-87450, and 59-88730, etc.

The principal of these processes is that when a light-sensitive silver halide and/or organic silver salt is reduced into silver through heat development, a mobile dye is produced or released in direct or inverse proportion to the reaction. The mobile dye is transferred to a dye fixing element.

These processes, however, have the drawbacks that a substantial sensitivity reduction is likely to occur, particularly when the light-sensitive material is stored for an extended period of time. This phenomenon is outstanding in silver halide emulsions using a sensitizing dye. It is therefore desired to overcome the shelf life or sensitivity reduction problem.

SUMMARY OF THE INVENTION

It is an object of the present invention to provide a heat-developable color light-sensitive material having retarded sensitivity reduction during storage while retaining comparable sensitivity and fogging.

According to the present invention, there is provided A heat-developable color light-sensitive material comprising on a support at least a light-sensitive silver halide emulsion, a binder, a compound capable of producing or releasing a mobile dye in direct or inverse proportion to the reaction of the light-sensitive silver halide being reduced into silver at elevated temperatures, and a dye having the general formula (I).

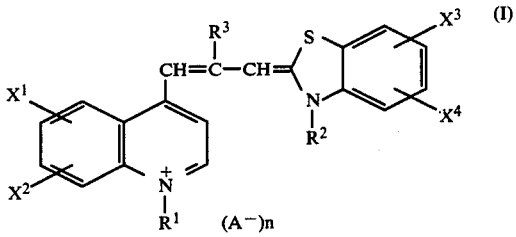

In formula (I), $R^1$ and $R^2$ are independently selected from the group consisting of substituted or unsubstituted alkyl and alkenyl groups, $R^3$ is selected from the group consisting of hydrogen atom and substituted or unsubstituted alkyl, alkoxy, aryl and alkenyl groups, $X^1$, $X^2$, $X^3$, and $X^4$ are independently selected from the group consisting of hydrogen atom, halogen atoms, hydroxyl group, carboxyl group, and substituted or unsubstituted alkyl groups, alkoxy groups, alkoxycarbonyl groups, acyl groups, acyloxyl groups, aryl groups, amino group, and acylamino groups, $X^1$ and $X^2$, and $X^3$ and $X^4$ can be mutually combined to form a benzene ring, $A^-$ is an anion, and n has a value equal to 0 or 1.

The term elevated temperatures used herein means temperatures in the range from about 80° C. to about 250° C., and preferably from about 110° C. to about 180° C.

DETAILED DESCRIPTION OF THE INVENTION

The heat-developable color light-sensitive materials of the present invention contains a dye having the general formula (I) for the purpose of spectral sensitization of silver halide (to be referred to as sensitizing dye, hereinafter).

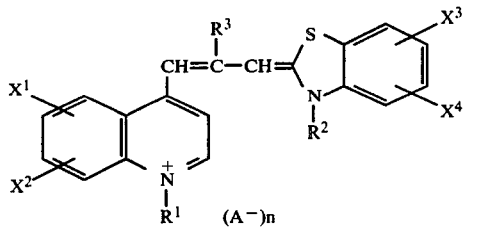

(I)

In formula (I), $R^1$ and $R^2$ are independently selected from the group consisting of substituted or unsubstituted alkyl and alkenyl groups as defined above. Specifically, the preferred groups represented by $R^1$ and $R^2$ are:

unsubstituted alkyl groups having 1 to 20 carbon atoms, such as methyl group, ethyl group, n-pentyl group, n-octyl group, etc.;

substituted alkyl groups having 1 to 20 carbon atoms, for example, sulfoalkyl groups such as 2-sulfoethyl group, 3-sulfopropyl group, 4-sulfobutyl group, etc.; carboxyalkyl groups such as 2-carboxyethyl group, 3-carboxypropyl group, etc.; hydroxyalkyl groups such as 2-hydroxyethyl group, 4-hydroxypropyl group, etc.; alkoxyalkyl groups such as 2-methoxyethyl group, 4-butoxybutyl group, etc.; aminoalkyl groups such as dimethylaminoethyl group, etc.; trialkylammonium alkyl groups such as trimethylammonium ethyl group, etc.; cyanoalkyl groups such as cyanoethyl group, cyanopropyl group, etc.; carbamoylalkyl groups such as 2-carbamoylethyl group, 4-carbamoylbutyl group, etc.; aralkyl groups such as benzyl group, phenetyl group, etc.; and substituted or unsubstituted alkenyl groups having 3 to 20 carbon atoms, for example, allyl group, etc., with the unsubstituted alkyl groups having 2 to 8 carbon atoms being most preferred.

$R^3$ is selected from the group consistig of hydrogen atom and substituted or unsubstituted alkyl, alkoxy, aryl and alkenyl groups as defined above. Specifically, the preferred groups represented by $R^3$ are:

hydrogen atom;

substituted or unsubstituted alkyl groups having 1 to 20 carbon atoms, such as methyl group, ethyl group, phenetyl group, methoxyethyl group, etc.;

substituted or unsubstituted alkoxyl groups having 1 to 20 carbon atoms, such as methoxy group, ethoxy group, etc.;

substituted or unsubstituted aryl groups having 6 to 14 carbon atoms, such as phenyl group, naphthyl group, etc.;

substituted or unsubstituted alkenyl groups having 3 to 20 carbon atoms, such as allyl group, etc., with the hydrogen atom and phenyl group being most preferred.

$X^1$, $X^2$, $X^3$, and $X^4$ are independently selected from the group consisting of hydrogen atom, halogen atoms, hydroxyl group, carboxyl group, and substituted or unsubstituted alkyl groups, alkoxy groups, alkoxycarbonyl groups, acyl groups, acyloxyl groups, aryl groups, amino group, and acylamino groups, as defined above. Specifically, the preferred groups represented by X's are:

hydrogen atom;

halogen atoms such as fluorine atom, chlorine atom, bromine atom, etc.;

hydroxyl group;

carboxyl group;

substituted or unsubstitited alkyl groups having 1 to 20 carbon atoms, such as methyl group, ethyl group, trifluomethyl group, etc.;

substituted or unsubstituted alkoxy groups having 1 to 20 carbon atoms, such as methoxy group, ethoxy group, etc.;

substituted or unsubstituted alkoxycarbonyl groups such as methoxycarbonyl group, ethoxycarbonyl group, etc.;

substituted or unsubstituted acyl groups such as acetyl group, etc.;

substituted or unsubstituted acyloxyl groups such as acetoxy group, etc.;

substituted or unsubstituted aryl groups having 6 to 14 carbon atoms, such as phenyl group, etc.;

substituted or unsubstituted amino groups such as amino group, methylamino group, dimethylamino group, etc.;

substituted or unsubstituted acylamino groups such as acetylamino group, etc.; with the methyl group, methoxy group, and chlorine atom being most preferred.

$X^1$ and $X^2$, and $X^3$ and $X^4$ may be mutually combined or concatenated to form a benzene ring. That is, $X^1$ and $X^3$ may be condensed with $X^2$ and $X^4$, respectively.

For example, $X^1$ and $X^2$ when combined may represent 5,6-benzo, 6,7-benzo, 7,8-benzo, etc. and $X^3$ and $X^4$ when combined may represent 4,5-benzo, 5,6-benzo, 6,7-benzo, etc.

$A^-$ may be either an inorganic anion or an organic anion. The preferred anions represented by $A^-$ are halogen ions such as fluorine anion, chlorine anion, bromine anion, iodine anion; substituted arylsulfonate anions such as p-toluenesulfonate anion; thiocyanate anion; perchlorate anion, etc., with the iodine, p-toluenesulfonate, and perchlorate ions being most preferred.

Principally, n has a value equal to 0 or 1. When n=0, the dye compound having formula (I) defined above forms an intramolecular salt.

When one or more cationic substituents are included in any groups of R's and X's, n may be increased in proportion to the number of such substituents.

Typical, but non-limiting examples of the sensitizing dyes having formula (I) defined above are given below. Each chemical structure is shown together with the value of the maximum absorption wavelength ($\lambda_{max\text{-}MeOH}$) of its visible-ultraviolet absorption spectrum in methanol (MeOH).

(1)

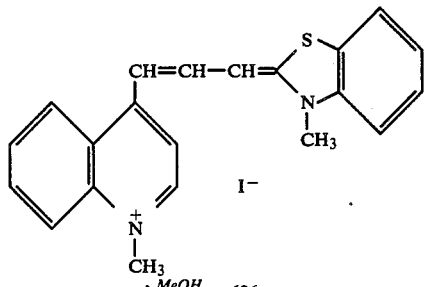

$\lambda_{max}^{MeOH} = 626$ nm

-continued
(2)
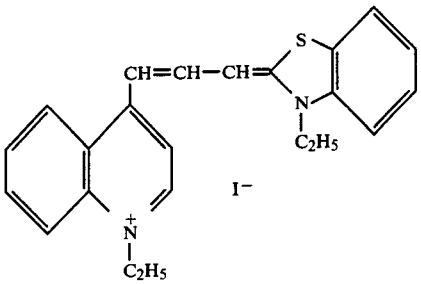
$\lambda_{max}^{MeOH}$ = 627 nm
(3)
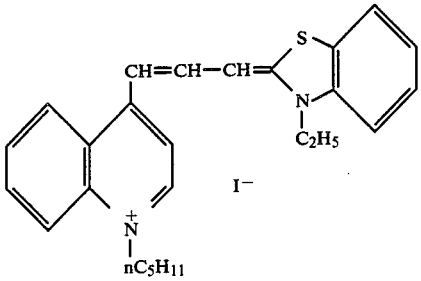
$\lambda_{max}^{MeOH}$ = 630 nm
(4)
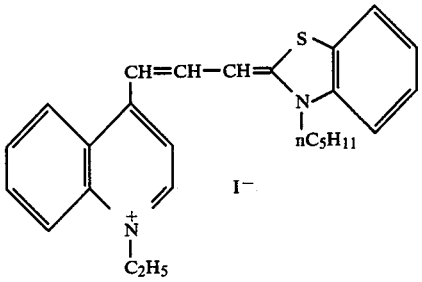
$\lambda_{max}^{MeOH}$ = 628 nm
(5)
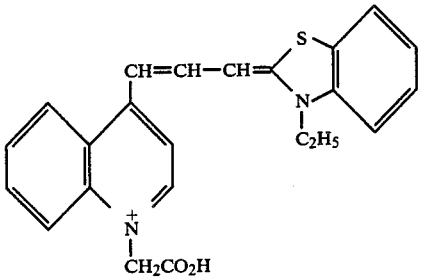
$\lambda_{max}^{MeOH}$ = 625 nm
(6)
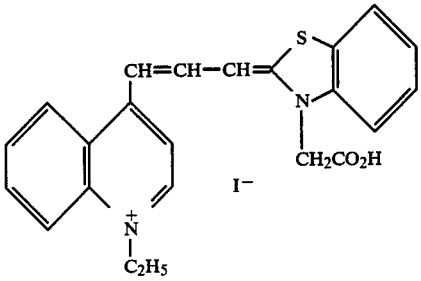
$\lambda_{max}^{MeOH}$ = 632 nm
-continued
(7)
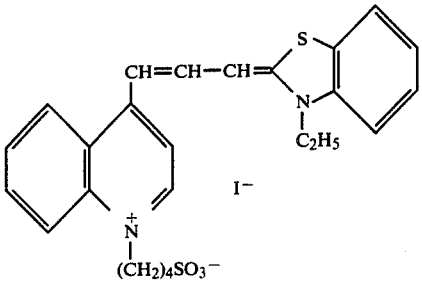
$\lambda_{max}^{MeOH}$ = 628 nm
(8)
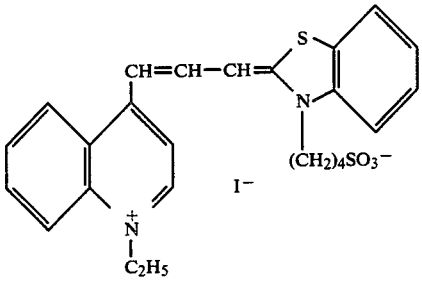
$\lambda_{max}^{MeOH}$ = 629 nm
(9)
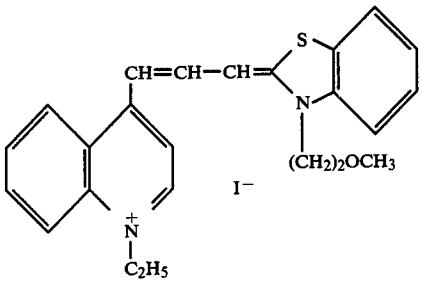
$\lambda_{max}^{MeOH}$ = 628 nm
(10)
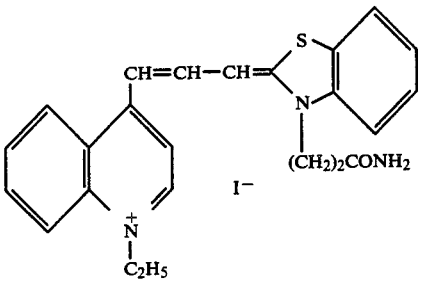
$\lambda_{max}^{MeOH}$ = 626 nm
(11)
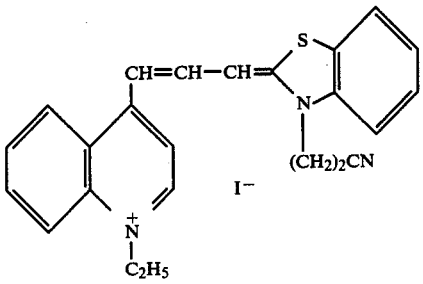
$\lambda_{max}^{MeOH}$ = 620 nm -continued
(12)
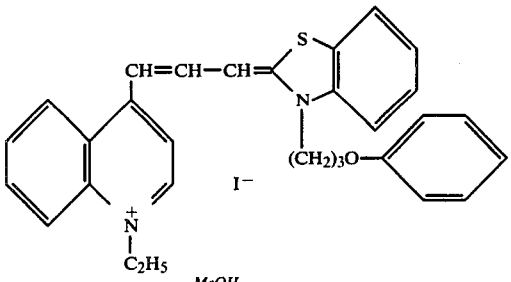
$\lambda_{max}^{MeOH} = 630$ nm
(13)
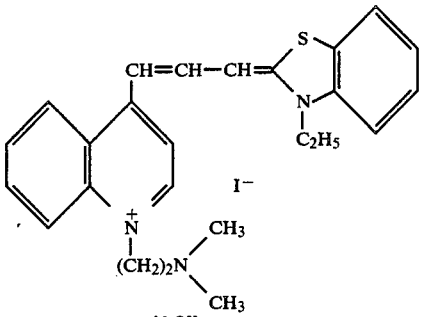
$\lambda_{max}^{MeOH} = 631$ nm
(14)
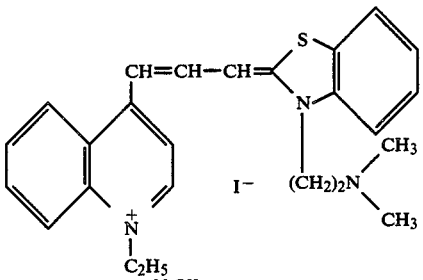
$\lambda_{max}^{MeOH} = 632$ nm
(15)
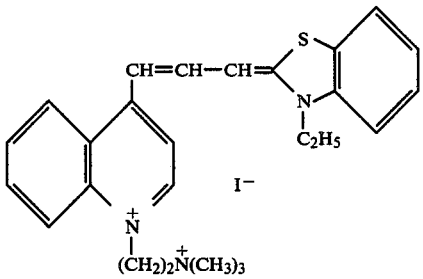
$\lambda_{max}^{MeOH} = 632$ nm
(16)
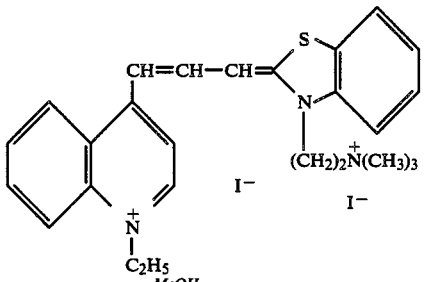
$\lambda_{max}^{MeOH} = 630$ nm
-continued
(17)
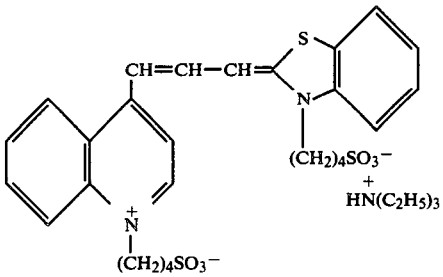
$\lambda_{max}^{MeOH} = 630$ nm
(18)
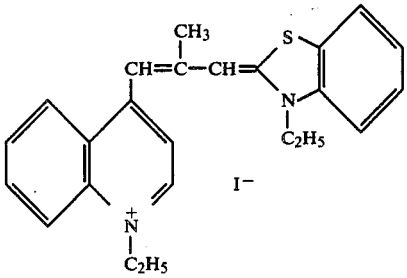
$\lambda_{max}^{MeOH} = 623$ nm
(19)
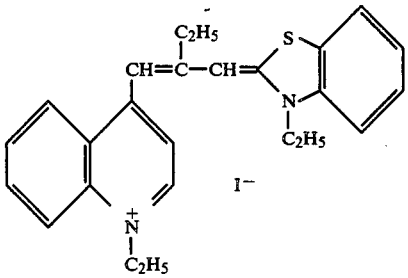
$\lambda_{max}^{MeOH} = 624$ nm
(20)
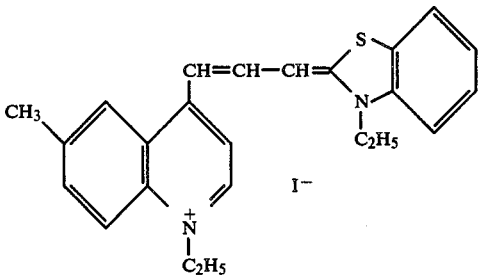
$\lambda_{max}^{MeOH} = 625$ nm
(21)
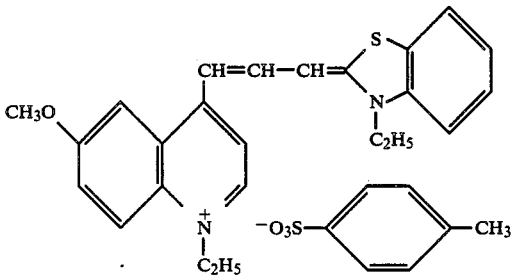
$\lambda_{max}^{MeOH} = 626$ nm -continued
(22)
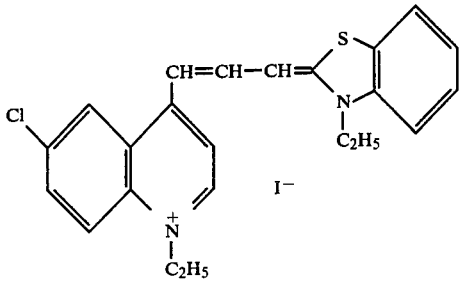
$\lambda_{max}^{MeOH}$ = 642 nm
(23)
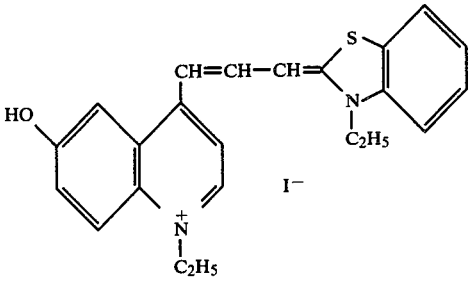
$\lambda_{max}^{MeOH}$ = 623 nm
(24)
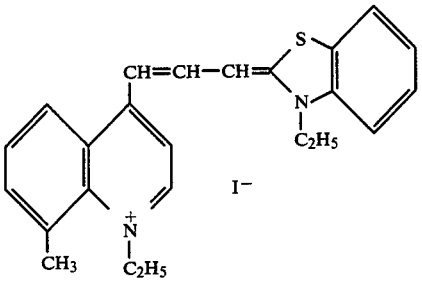
$\lambda_{max}^{MeOH}$ = 632 nm
(25)
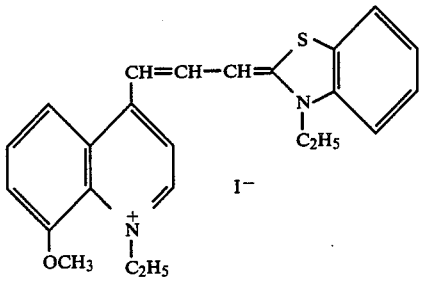
$\lambda_{max}^{MeOH}$ = 626 nm
(26)
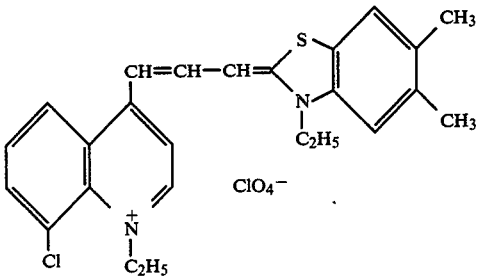
$\lambda_{max}^{MeOH}$ = 652 nm
-continued
(27)
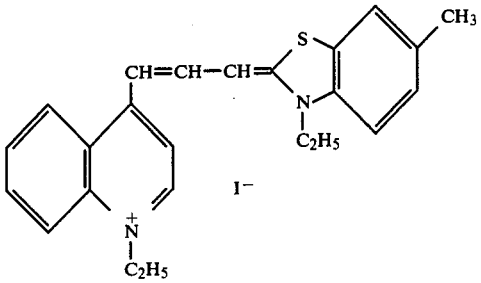
$\lambda_{max}^{MeOH}$ = 639 nm
(28)
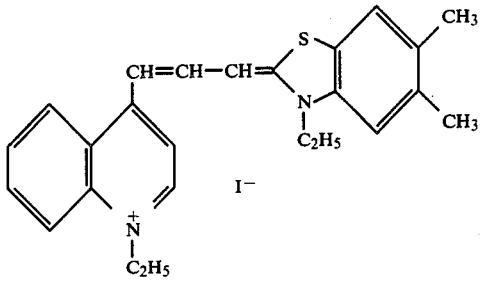
$\lambda_{max}^{MeOH}$ = 640 nm
(29)
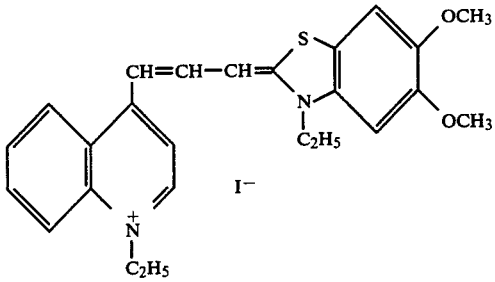
$\lambda_{max}^{MeOH}$ = 659 nm
(30)
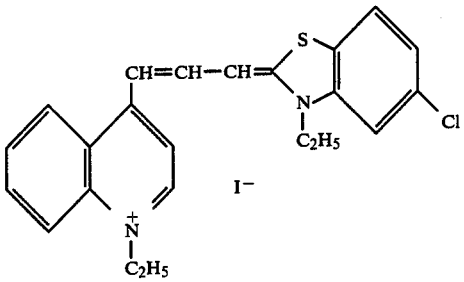
$\lambda_{max}^{MeOH}$ = 622 nm
(31)
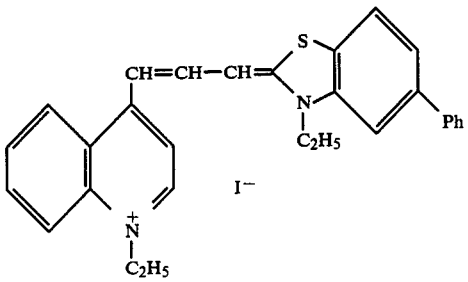
$\lambda_{max}^{MeOH}$ = 632 nm -continued
(32)
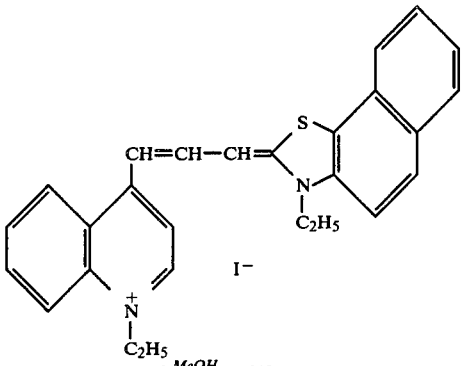
$\lambda_{max}^{MeOH}$ = 648 nm
(33)
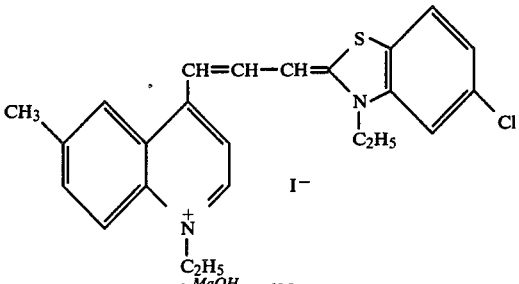
$\lambda_{max}^{MaOH}$ = 625 nm
(34)
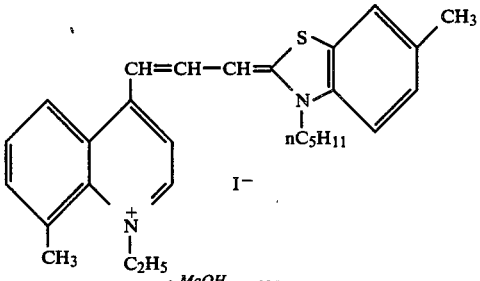
$\lambda_{max}^{MaOH}$ = 635 nm
(35)
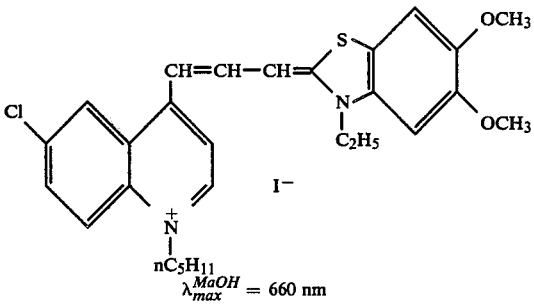
$\lambda_{max}^{MaOH}$ = 660 nm
(36)
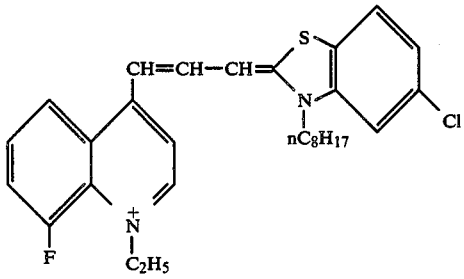
$ClO_4^-$
$\lambda_{max}^{MaOH}$ = 630 nm
-continued
(37)
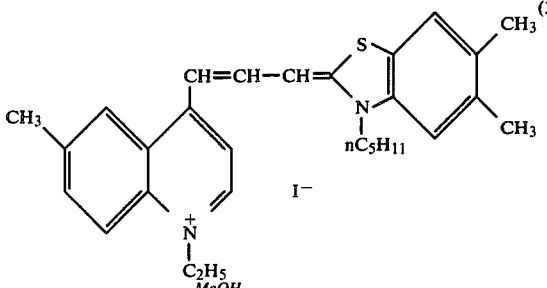
$\lambda_{max}^{MaOH}$ = 637 nm
(38)
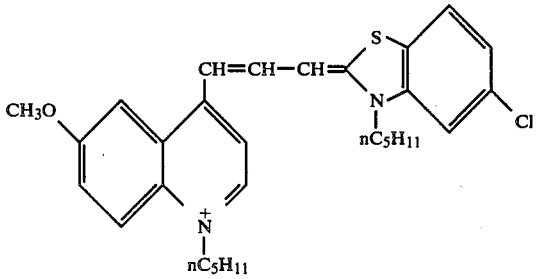
$ClO_4^-$
$\lambda_{max}^{MaOH}$ = 620 nm
(39)
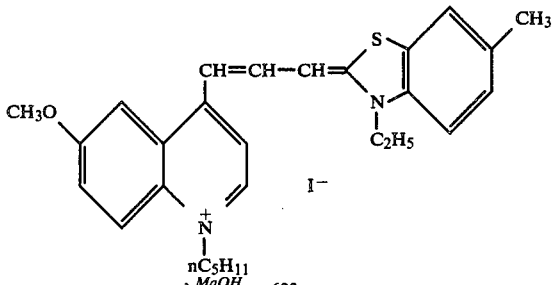
$\lambda_{max}^{MaOH}$ = 633 nm
(40)
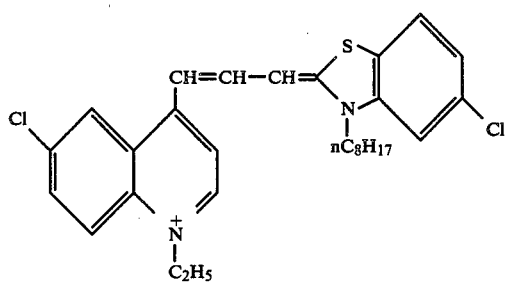
$ClO_4^-$
$\lambda_{max}^{MaOH}$ = 632 nm
(41)
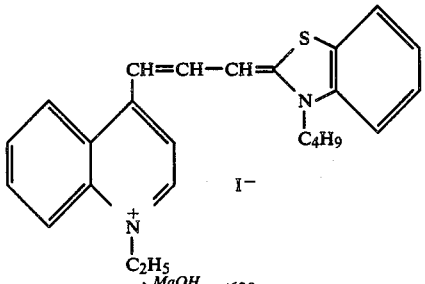
$\lambda_{max}^{MaOH}$ = 630 nm -continued (42)

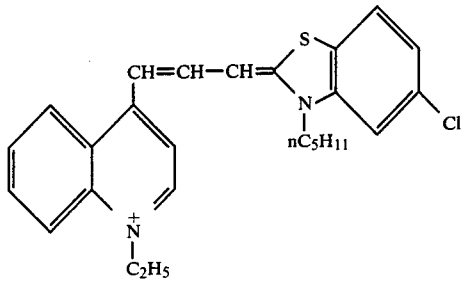

$ClO_4^-$ $\lambda_{max}^{MaOH} = 629$ nm (43)

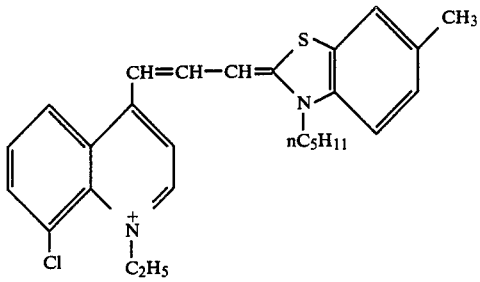

$ClO_4^-$ $\lambda_{max}^{MaOH} = 635$ nm (44)

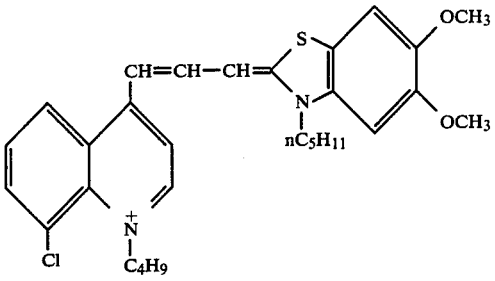

$ClO_4^-$ $\lambda_{max}^{MaOH} = 655$ nm (45)

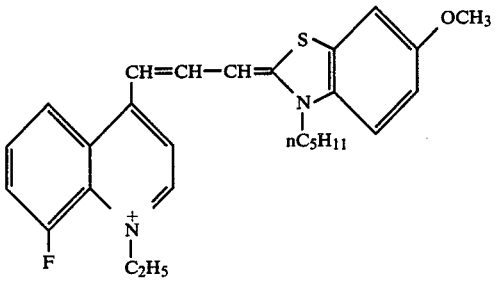

$ClO_4^-$ $\lambda_{max}^{MaOH} = 640$ nm

-continued (46)

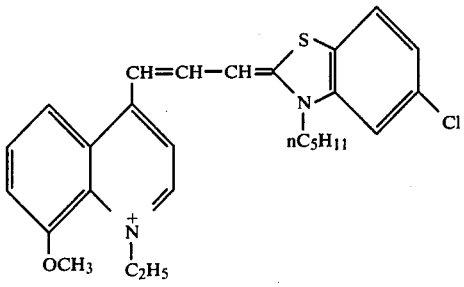

$ClO_4^-$ $\lambda_{max}^{MaOH} = 624$ nm

The sensitizing dyes having formula (I) which can be used in the practice of the present invention may be readily synthesized by any known processes as disclosed in F. M. Hamer, "Heterocyclic Compounds-Cyanine and relataed compound-", John Wiley & Sons, New York, London, and D. M. Sturner, "Heterocyclic Compounds-Special topics in heterocyclic chemistry-", John Wiley & Sons, New York, London (1977), and the like.

The following examples are illustrative of the typical synthesis of these sensitizing dyes.

SYNTHESIS OF SENSITIZING DYE (2)

Process A

Ten (10) grams 4-acetoanilidoethenequinolium-1-ethyl iodide and 7.6 grams 3-ethyl-2-methyl-benzothiazolium iodide were dissolved in 300 ml methanol and with stirring, 8 ml triethylamine added to the solution. After stirring for 1 hour, the precipitated crystals were suction filtered again dissolved in methanol (200 ml)/chloroform (200 ml) by heating. The solution was filtered and concentrated to a volume of 250 ml. The concentrate was allowed to cool and the precipitated crystals were suction filtered, obtaining sensitizing dye (2) in a yield of 10 grams.

mp 268–270° C.

$\lambda_{max}^{MeOH} = 627$ nm ($\epsilon = 1.41 \times 10^5$).

Process B

Three (3) grams of 2-acetoanilidoethene-3-ethylbenzothiazolium iodide and 2.2 grams 1-ethyl-4-methylquinolium iodide were dissolved in 100 ml methanol and with stirring, 2 ml triethylamine added to the solution. After stirring for 1 hour, the precipitated crystals were suction filtered and again dissolved in methanol (100 ml)/chloroform (100 ml) by heating. The solution was filtered and concentrated to a volume of 130 ml. the concentrate was allowed to cool and the precipitated crystals were suction filtered, obtaining sensitizing dye (2) in a yield of 3 grams. Other sensitizing dyes may be similarly synthesized by either of processes A and B.

These sensitizing dyes are contained in the light-sensitive silver halide emulsion upon use. In such a case, the sensitizing dyes may be used alone or in admixture of two or more. The sensitizing dyes are generally contained in the light-sensitive silver halide emulsion in amounts of about $10^{-8}$ to about $10^{-2}$ moles per mole of silver halide.

the sensitizing dyes may be contained in the silver halide photographic emulsion either by dispersing them directly in the emulsion or by dissolving them in a suitable solvent such as water, methanol, ethanol, acetone, methyl cellosolve, etc. alone or mixtures thereof and then adding the resulting solution to the emulsion. Alternatively, the sensitizing dyes may be dissolved in a solvent substantially immiscible with water such as phenoxyethanol and then dispersed in water or hydrophilic colloid. The resulting dispersion is added to the emulsion. It is also possible to mix the sensitizing dyes with a lipophilic compound such as a dye-providing compound and add them to the emulsion at the same time. When more than one sensitizing dye is used, they may be dissolved in a solvent either separately or as a mixture. Also, they may be added to the emulsion either separately or as a mixture of them or with another additive. The sensitizing dyes may be added to the emulsion during or around chemical aging or around the nucleation of silver halide particles according to U.S. Pat. Nos. 4,183,756 and 4,225,666.

The heat-developable color light-sensitive materials of the present invention further contains a compound capable of producing or releasing a mobile dye. Preferred among them are those compounds which possess a dye moiety within their molecule and when reduced by the light-sensitive silver halide at elevated temperatures, release the dye moiety from the molecule in direct or inverse proportion to the reaction to form the dye having a different diffusibility from the molecule. These compounds are simply referred to as dye-providing substances hereinafter.

Preferred dye-providing substances which can be employed in the present invention may be represented by the following formula (C I):

$$(\text{Dye-X})_q\text{-Y} \qquad \text{(C I)}$$

wherein Dye represents a dye which possesses a different diffusibility from the compound represented by $(\text{Dye-X})_q$-Y when it is released from the molecule. The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form having temporarily shortened wavelengths, the color of which is recoverable in the development processing. More specifically, those dyes described in European patent application No. 76,492 may be utilized.

q represents an integer of 1 or 2. When q=2, the Dye-X's may be the same or different.

X represents a simple bond or a connecting group. Examples of the connecting group represented by X include —NR— (wherein R represents a hydrogen atom, an alkyl group, or a substituted alkyl group), —$SO_2$—, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

Y represents a group which releases Dye in correspondence or countercorrespondence to light-sensitive silver salts having a latent image distributed imagewise, the diffusibility of Dye released being different from that of the compound represented by Dye-X-Y.

The preferred compounds represented by Dye-X-Y are those compounds which themselves are resistant to diffusion and release a mobile Dye. Preferably, the dye released is moved to and fixed in a dye-fixing layer, thereby forming a color image in the dye-fixing layer.

Exemplary of the dye-providing substances having general formula (C I) there may be given dye developing reagents in the form of a hydroquinone-type developing reagent having a dye moiety attached thereto as disclosed in U.S. Pat. Nos. 3,134,764; 3,362,819; 3,597,200; 3,544,545 and 3,482,972. In addition, substances which release a diffusible dye through intramolecular nucleophilic substitution reaction are disclosed in Japanese patent application Kokai No. 51-63618 and substances which release a diffusible dye through intramolecular rewind reaction of an isooxazolone ring are disclosed in Japanese patent application Kokai No. 49-111628. The system to which these substances are applied are that a diffusible dye is released or diffused where no development has taken place. No dye is released or diffused where development has taken place.

Since development and release or diffusion of the dye concurrently occur in these systems, it is very difficult to obtain an image having a high S/N ratio. In order to overcome this drawback, another system is proposed wherein the dye-providing substance is previously modified into an oxidant form having no dye releasing ability so that the modified substance may coexist with a reducing agent or precursor thereof. After development, the reducing agent which remains non-oxidized acts on the modified substance to reduce it, thereby releasing the diffusible dye. Typical examples of the dye-providing substances usable in such a system are described in Japanese patent application Kokai Nos. 53-110827, 54-130927, 56-164342, and 53-35533.

Also known are substances which release a diffusible dye where development has occurred. The substances which release a diffusible dye through the reaction of an oxidation product of a developing reagent with a coupler having a diffusible dye as an eliminatable group are described in U.K. Pat. No. 1,330,524; Japanese Patent Publication No. 48-39165; U.S. Pat. No. 3,443,940 and the like, and the substances which produce a diffusible dye through the reaction of an oxidation product of a developing reagent with a coupler having an anti-diffusible group as an eliminatable group are described in U.S. Pat. No. 3,227,550 and the like.

The systems using these color developing agents have the serious problem that the resulting image can be contaminated with oxidation decomposition products of a developing agent. To overcome this problem, a dye-releasing compound which itself has a reducing ability without the need for a developing agent have been used. Typical examples of these compounds are presented below together with the patent or literature disclosing them. The definition of legends in the formulae is given in the corresponding literature.

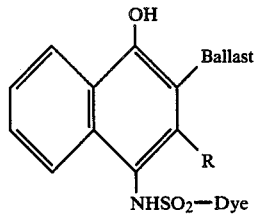

U.S. Pat. No. 3,928,312, etc.

-continued

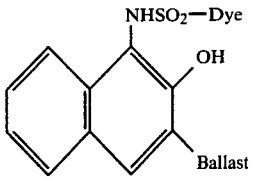

U.S. Pat. No. 4,053,312, etc.

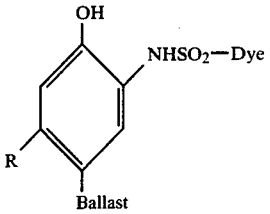

U.S. Pat. No. 4,055,428, etc.

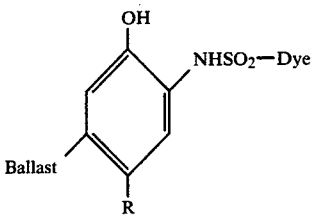

U.S. Pat. No. 4,336,322

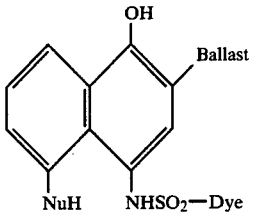

JP Pat. Appln. Kokai No. 59-65,839

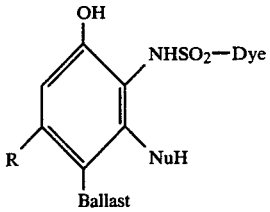

JP Pat. Appln. Kokai No. 59-69,839

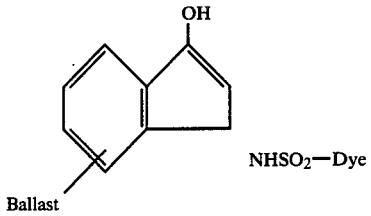

JP Pat. Appln. Kokai No. 53-3,819

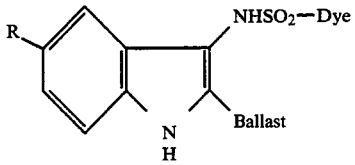

JP Pat. Appln. Kokai No. 51-104,343

-continued

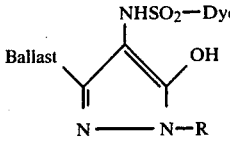

JP Pat. Appln. Kokai No. 51-104,343

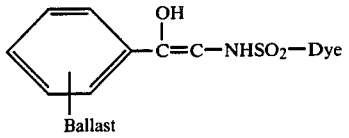

JP Pat. Appln. Kokai No. 51-104,343

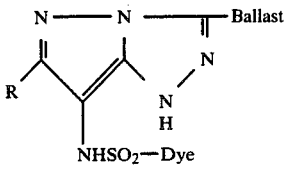

Research Disclosure, No. 17,465

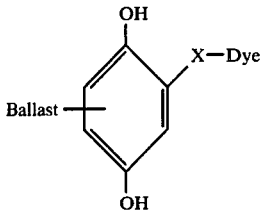

U.S. Pat. No. 3,725,062

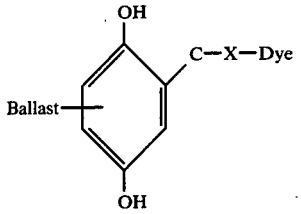

U.S. Pat. No. 3,728,113

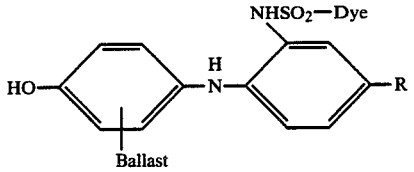

U.S. Pat. No. 3,443,939

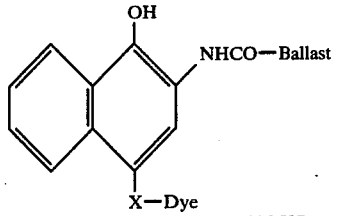

JP Pat. Appln. Kokai No. 58-116,537

Any of the foregoing dye-providing substances may be used in the practice of the present invention.

The dye-providing substance which can be a reducing agent capable of releasing a diffusible dye useful in the present invention is preferably represented by the general formula (C II):

$IR—SO_2-D.$ (C II)

In formula (C II), IR is a reducing substrate of the type capable of cleavage in direct or inverse proportion to a light-sensitive silver halide having imagewise latent images to release a dye, forming a difference in mobility between the released dye and the dye-providing substance. D represents an image-forming dye (or precursor thereof) moiety having mobility and may include a linkage connecting a "pure" dye portion and the $SO_2$ group.

The reducing substrate IR in the dye-providing substance $IR—SO_2-D$ is preferably one which exhibits an oxidation-reduction potential of up to 1.2 volts with respect to the saturated calomel electrode in polarographic half-wave potential measurement using acetonitrile as a solvent and sodium perchlorate as a supporting electrolyte.

Illustrative of the reducing substrate represented by IR are those groups described in Japanese patent application No. 57-194202, pages 17–37, and among others particularly preferred are those groups having the general formula (C III):

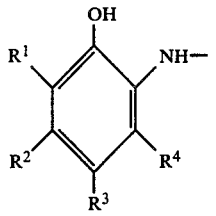

(C III)

wherein $R^1$, $R^2$, $R^3$, and $R^4$ are independently selected from the group consisting of hydrogen atom, alkyl groups, cycloalkyl groups, aryl groups, alkoxy groups, aryloxy groups, aralkyl groups, acyl groups, acylamino groups, alkylsulfonylamino groups, arylsulfonylamino groups, aryloxyalkyl groups, alkoxyalkyl groups, N-substituted carbamoyl groups, N-substituted sulfamoyl groups, halogen atoms, alkylthio groups, and arylthio groups. The alkyl and aryl group moieties of the foregoing groups may be further replaced by any of alkoxy, halogen, hydroxyl, cyano, acyl, acylamino, substituted carbamoyl, substituted sulfamoyl, alkylsulfonylamino, arylsulfonylamino, substituted ureido, and carboalkoxy groups. The hydroxyl and amino groups in IR may be protected by a protective group such that they may be regenerated by the action of a nucleophilic reagent.

In a further preferred embodiment, the reducing substrate IR has the general formula (C IV):

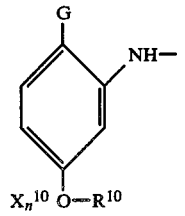

(C IV)

wherein G is a hydroxyl group or a group hydrolyzable into a hydroxyl group, and $R^{10}$ is an alkyl group or aromatic group.

When n=1, $X^{10}$ represents an electron donative substituent. When n=2 or 3, they may be the same or different substituents. When one of the substituents $X^{10}$ is an electron donative group, the second and/or third may be an electron donative group or halogen atom and $X^{10}$ may form a condensed ring by itself or form a ring with $OR^{10}$. The total number of carbon atoms contained in $R^{10}$ and $X^{10}$ is at least 8.

More preferred reducing substrates IR included in formula (C IV) are those having the general formulas (C IVa) and (C IVb).

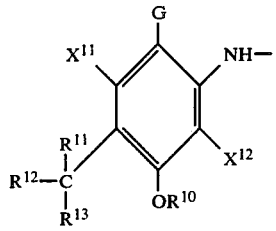

(C IVa)

In formula (C IVa), G is a hydroxyl group or a group hydrolyzable into a hydroxyl group; $R^{10}$ is an alkyl group or aromatic group; $R^{11}$ and $R^{12}$ may be the same or different and independently selected from alkyl groups or $R^{11}$ and $R^{12}$ may be combined to form a ring; and $R^{13}$ is a hydrogen atom or alkyl group. $X^{11}$ and $X^{12}$ may be the same or different and independently selected from hydrogen atom, alkyl groups, alkyloxy groups, halogen atoms, acylamino groups, and alkylthio groups, and $R^{10}$ and $X^{12}$ or $R^{10}$ and $R^{13}$ may be combined to form a ring.

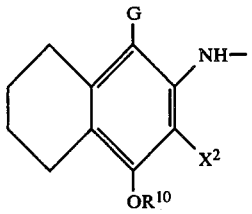

(C IVb)

In formula (C IVb), G is a hydroxyl group or a group hydrolyzable into a hydroxyl group; $R^{10}$ is an alkyl group or aromatic group; $X^2$ is a hydrogen atom, alkyl group, alkyloxy group, halogen atom, acylamino group, or alkylthio group; and $X^2$ and $R^{10}$ may be combined to form a ring.

Illustrative examples included within the scope of formulae (C IV), (C IVa), and (C IVb) are described in U.S. Pat. No. 4,055,428, Japanese patent application Kokai Nos. 56-12642 and 56-16130, respectively.

In a further preferred embodiment, the reducing substrate IR has the general formula (C V):

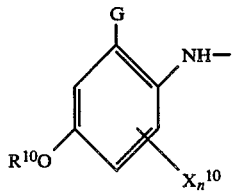

(C V)

wherein G, $X^{10}$, $R^{10}$, and n are as defined for formula (C IV).

More preferred reducing substrates IR included in formula (C V) are those having the general formulas (C Va), (C Vb), and (C Vc).

(C Va)

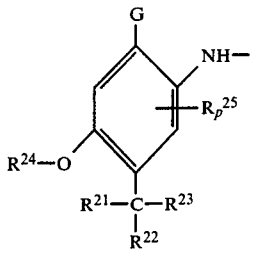

In formula (C Va), G is a hydroxyl group or a group hydrolyzable into a hydroxyl group; $R^{21}$ and $R^{22}$ may be the same or different and independently selected from alkyl groups and aromatic groups or $R^{21}$ and $R^{22}$ may be combined to form a ring; $R^{23}$ is a hydrogen atom, alkyl group, or aryl group; $R^{24}$ is an alkyl group or aromatic group; $R^{25}$ is an alkyl group, alkoxy group, alkylthio group, arylthio group, halogen atom, or acylamino group; and p is 0, 1 or 2. $R^{24}$ and $R^{25}$ may be combined to form a condensed ring; $R^{21}$ and $R^{24}$ may be combined to form a condensed ring; $R^{21}$ and $R^{25}$ may be combined to form a condensed ring; and the total number of carbon atoms contained in $R^{21}$, $R^{22}$, $R^{23}$, $R^{24}$, and $R^{25}_p$ is at least 7.

(C Vb)

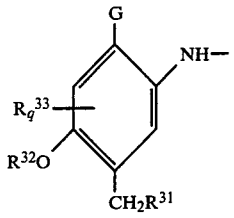

In formula (C Vb), G is a hydroxyl group or a group hydrolyzable into a hydroxyl group; $R^{31}$ is an alkyl group or aromatic groups; $R^{32}$ is an alkyl group or aromatic groups; $R^{33}$ is an alkyl group, alkoxy group, alkylthio group, arylthio group, halogen atom, or acylamino group; and q is 0, 1 or 2. $R^{32}$ and $R^{33}$ may be combined to form a condensed ring; $R^{31}$ and $R^{32}$ may be combined to form a condensed ring; $R^{31}$ and $R^{33}$ may be combined to form a condensed ring; and the total number of carbon atoms contained in $R^{31}$, $R^{32}$, and $R^{33}_q$ is at least 7.

(C Vc)

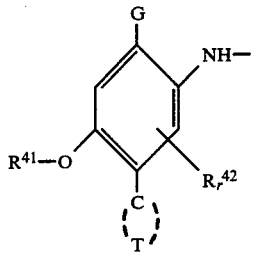

In formula (C Vc), G is a hydroxyl group or a group hydrolyzable into a hydroxyl group; $R^{41}$ is an alkyl group or aromatic groups; $R^{42}$ is an alkyl group, alkoxy group, alkylthio group, arylthio group, halogen atom, or acylamino group; and r is 0, 1 or 2.

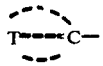

group represents a group having 2 to 4 saturated hydrocarbon rings condensed and the carbon atom

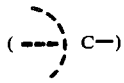

in the condensed ring participating in its attachment to the phenol (or precursor thereof) mother nucleus is a tertiary carbon atom constituting one of the key members of the condensed ring. Some of the carbon atoms in the hydrocarbon ring except said tertiary carbon atom may be replaced by oxygen atoms or the hydrocarbon ring may have a substituent attached thereto or an aromatic ring condensed therewith. $R^{41}$ or $R^{42}$ may form a condensed ring with the above-defined

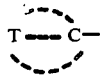

group. The total number of carbon atoms contained in $R^{41}$, $R^{42}_r$, and

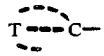

is at least 7.

Preferred examples of IR are given below.

(R-1)

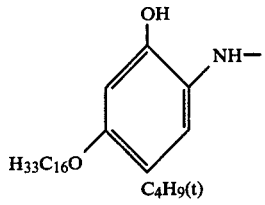

(R-2)

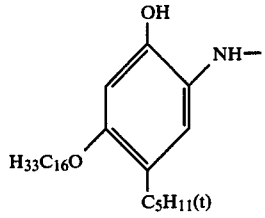

(R-3)

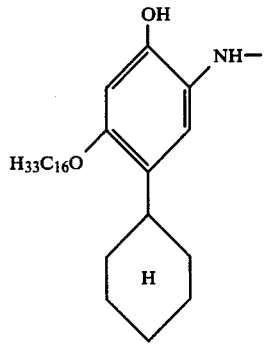

-continued (R-4)

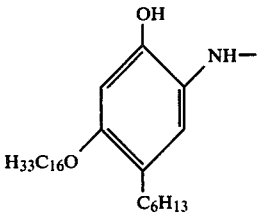

(R-5)

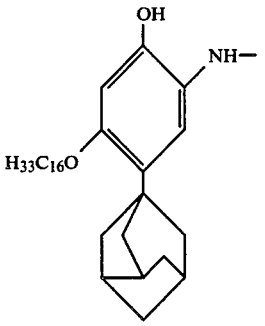

(R-6)

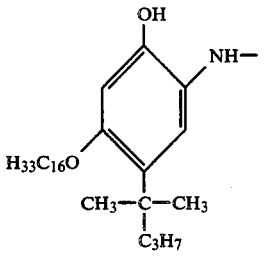

(R-7)

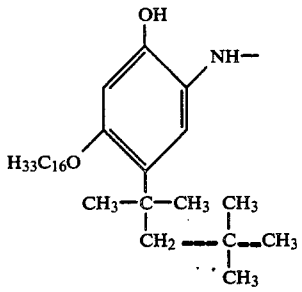

(R-8)

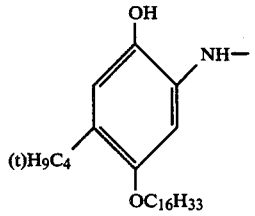

(R-9)

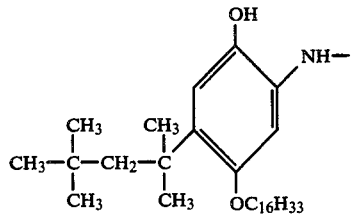

-continued (R-10)

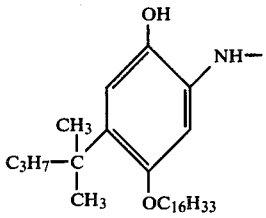

(R-11)

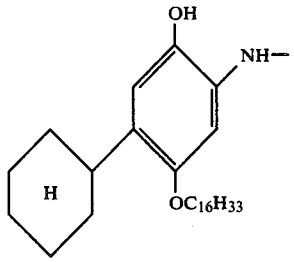

(R-12)

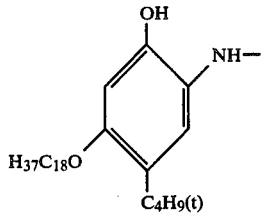

The dye moieties represented by D in formula (C II) are those derived from azo dyes, azomethine dyes, anthraquinone dyes, naphthoquinone dyes, styryl dyes, nitro dyes, quinoline dyes, carbonyl dyes and phthalocyanine dyes, etc. These dye moieties can also take the form having temporarily shortened wavelengths. Illustrative examples of the dye moieties released from dye-providing substances are shown in the above-cited Japanese Patent Publication No. 57-194202, pages 37–59.

Exemplary of the dye-providing substances which can be used in the practice of the present invention, there may be given those compounds described in the above-cited Japanese Patent Publication No. 57-194202, pages 60–91. Particularly preferred among the compounds shown on the indicated pages are those compounds labelled as Compounds (1)–(3), (10)–(13), (16)–(19), (28)–(30), (33), (35), (38)–(40), and (42)–(64). Also useful are cyan and yellow dye-providing substances as shown below.

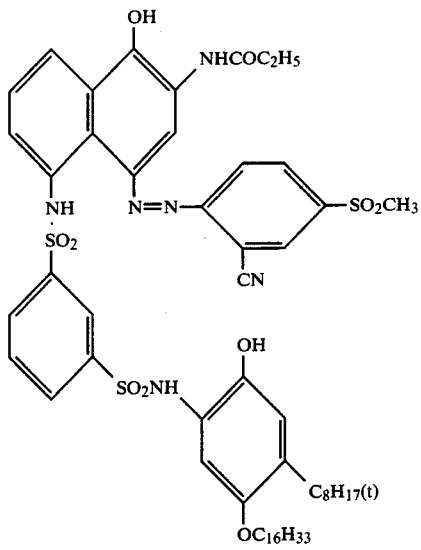

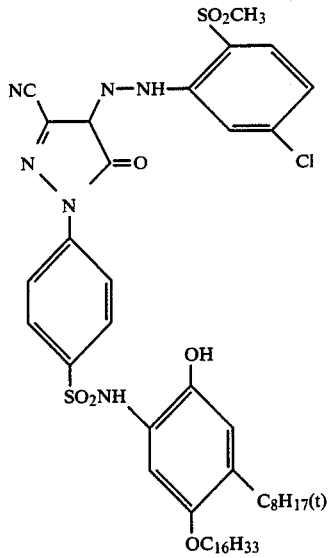

The dye-providing material may be used at concentrations in a certain range. In general, the useful concentration ranges from about 0.01 to about 4 moles of dye-providing substance per mole of silver halide. The particularly useful concentration ranges from about 0.03 to about 1 mole per mole of silver halide.

The dye-releasing or providing substance used in the present invention can be introduced into a layer of the photosensitive material by known methods such as a method as described in U.S. Pat. No. 2,322,027. In this case, an organic solvent having a high boiling point or an organic solvent having a low boiling point as described below may be used. For example, the dye-providing substance is first dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), and a trimesic acid ester (for example, tributyl trimesate, etc.); or an organic solvent having a boiling point of about 30° C. to 160° C., for example, a lower alkyl acetate such as ethyl acetate, butyl acetate, etc., ethyl propionate, sec-butyl alcohol, methyl isobutyl ketone, β-ethoxyethyl acetate, methyl cellosolve acetate, cyclohexanone, etc. Mixtures of the above described high boiling organic solvents and low boiling organic solvents may also be used. The solution of the dye-providing substance may then be dispersed in a hydrophilic colloid.

Further, it is possible to use a method for dispersion in polymers as described in Japanese Patent Publication No. 51-39853 and Japanese Patent Application Kokai No. 51-59943. Moreover, various surface-active agents may be used when the dye-providing substance is dispersed in a hydrophilic colloid. For this purpose, the surface-active agents illustrated in other part of the specification may be used.

The high-boiling organic solvent may be used in the practice of the present invention in amounts of up to 10 grams, preferably up to 5 grams per gram of dye-providing substance.

The silver halides used in the present invention include silver chloride, silver chlorobromide, silver chloroiodide, silver bromide, silver iodobromide, silver chloroiodobromide, and silver iodide, but not limited thereto. The silver halide grains may have a uniform halogen composition or a multiple structure varying in composition from the surface to the interior (see Japanese Patent Application Kokai Nos. 57-154232, 58-108533, 59-48755, and 59-52237; U.S. Pat. No. 4,433,048; and European Pat. No. 100,984). Also useful are plate particles having a thickness of up to 0.5 μm, a diameter of at least 0.6 μm, and an average aspect ratio of at least 5 (see U.S. Pat. Nos. 4,414,310 and 4,435,499 and German Patent Application (OLS) No. 3,241,646A1) and monodispersed emulsion having approximately uniform grain size distribution (see Japanese Patennt Application Kokai Nos. 57-178235, 58-100846, and 58-14829, International Publication 83/02338A1, European Patent Nos. 64,412A3 and 83,377A1). More than one silver halide having different crystal habit, halogen composition, grain size, or grain size distribution may also be used in admixture. More than one monodispersed emulsion having different grain size may be mixed so as to regulate gradation.

The average grain size of the silver halide used in the present invention is preferably from 0.001 μm to 10 μm and more preferably from 0.001 μm to 5 μm. The silver halide emulsion may be prepared by any of acidic, neutral, and ammoniacal methods while the type of reaction of soluble silver salt with soluble halide may be a single-jet and/or double-jet method. Also employable are reverse-mixing where grains are formed in the presence of an excess of silver ions and the controlled double-jet method where a constant pAg is kept. In order to accelerate grain growth, the concentration, amount, and addition rate of silver salt and halide added may be increased (see Japanese Patent Application Kokai Nos. 55-142329 and 55-158124 and U.S. Pat. No. 3,650,757). Silver halide grains of epitaxial junction type may also be used (see Japanese Patent Application Kokai No. 56-16124 and U.S. Pat. No. 4,094,684).

When a silver halide is used alone without combining an organic silver salt-oxidizing agent, the silver chloroiodide, iodobromide, and chloroiodobromide in which the X-ray pattern of silver iodide crystals is observable may preferably be used.

The process for preparing these silver halides is explained with reference to the preparation of silver iodobromide. That is, silver idodobromide is prepared by first adding silver nitrate solution to potassium bromide solution to form silver bromide particles and then adding potassium iodide to the mixture.

In preparing the silver halide grains useful in the practice of the present invention, any suitable solvent for the silver halide may be used, for example, ammonia, organic thioether derivatives as disclosed in Japanese Patent Publication No. 47-11386, and sulfur-containing compounds as disclosed in Japanese Patent Application Kokai No. 53-144319.

In the stage of grain forming or physical ripening, there may coexist such salts as cadmium, zinc, lead, and thallium salts.

For the purpose of improving high or low intensity reciprocity law failure, there may be employed water-soluble iridium salts such as iridium (III, IV) chlorides and ammonium hexachloroiridate, and water-soluble rhodium salts such as rhodium chloride.

The silver halide emulsions may be removed of soluble salts after precipitate forming or physical ripening and thus be subjected to noodle washing or settlement process.

The silver halide emulsions may be applied without post-ripening, but ordinarily after chemical sensitization. For chemical sensitization purpose, there may be used sulfur sensitization, reducing sensitization, noble metal sensitization and other processes which are well known in connection with the emulsions for light-sensitive materials of the ordinary type, and combinations thereof. Such chemical sensitization may be carried out in the presence of a nitrogen-containing heterocyclic compound as disclosed in Japanese Patent Application Kokai Nos. 58-126526 and 58-215644.

The silver halide emulsions used in the practice of the present invention may be either of the surface latent image type wherein latent images are predominantly formed on the grain surface or of the internal latent image type wherein latent images are formed in the grain interior. Also employable is a direct reversal emulsion having an internal latent image type emulsion combined with a nucleating agent. The internal latent image type emulsions useful for this purpose are described in U.S. Pat. Nos. 2,592,250 and 3,761,276, Japanese Patent Publication No. 58-3534 and Japanese Patent Application Kokai No. 57-136641, and the like. The nucleating agents suitable for use in such combination are described in U.S. Pat. Nos. 3,227,552, 4,245,037, 4,255,511, 4,266,031, and 4,276,364, OLS No. 2,635,316, and the like.

The amount of the photosensitive silver halide coated preferably ranges from 1 $mg/m^2$ to 10 $g/m^2$ of silver.

In the practice of the present invention, an organic metal salt which is relatively stable to light may be used as an oxidizing agent in combination with the photosensitive silver halide. It is necessary that the photosensitive silver halide and the organic metal salt be in contact with or close to each other. Preferred among these organic metal salts are organic silver salts. The organic metal salt incorporated in the heat-developable photosensitive material in combination with the silver halide is believed to participate in redox reaction by the catalysis of a latent image of silver halide when the heat-developable photosensitive material is heated to a temperature of at least 80° C., preferably at least 100° C.

Exemplary of the organic compounds which can be used to form the above-mentioned organic silver salt oxidizing agents, there may be given aliphatic and aromatic carboxylic acids, thiocarbonyl-containing compounds having a mercapto group or alpha-hydrogen, imino-containing compounds, and the like.

Typical examples of the silver salts of aliphatic carboxylic acids include silver salts derived from behenic acid, stearic acid, oleic acid, lauric acid, capric acid, myristic acid, palmitic acid, maleic acid, fumaric acid, tartaric acid, furoic acid, linolic acid, linoleic acid, adipic acid, sebacic acid, succinic acid, acetic acid, butyric acid, and camphoric acid. Also employable are those silver salts derived from halogen or hydroxy-substituted ones of these fatty acids and aliphatic carboxylic acids having a thioether group.

Typical examples of the silver salts of aromatic carboxylic acids and other carboxyl-containing compounds include silver salts derived from benzoic acid, 3,5-dihydroxybenzoic acid, o-, m- or p-methylbenzoic acid, 2,4-dichlorobenzoic acid, acetamidebenzoic acid, p-phenylbenzoic acid, gallic acid, tannic acid, phthalic acid, terephthalic acid, salicylic acid, phenylacetic acid, pyromellitic acid, and 3-carboxymethyl-4-methyl-4-thiazoline-2-thione. Typical examples of the silver salts of mercapto or thiocarbonyl-containing compounds include silver salts derived from 3-mercapto-4-phenyl-1,2,4-triazole, 2-mercaptobenzimidazole, 2-mercapto-5-aminothiadiazole, 2-mercaptobenzothiazole, S-$C_{(12-22)}$alkylthioglycolic acids, dithiocarboxylic acids such as dithioacetic acid, thioamides such as thiostearoamide, 5-carboxy-1-methyl-2-phenyl-4-thiopyridine, and mercapto compounds as disclosed in U.S. Pat. No. 4,123,274, for example, mercaptotriazine, 2-mercaptobenzoxazole, mercaptooxadiazole, and 3-amino-5-benzylthio-1,2,4-triazole.

Typical examples of the silver salts of imino-containing compounds include silver salts derived from benzotriazole and its derivatives as disclosed in Japanese Patent Publication Nos. 44-30270 and 45-18416, for example, benzotriazole, alkyl-substituted benzotriazoles such as methylbenzotriazole, halo-substituted benzotriazoles such as 5-chlorobenzotriazole, and carboimidebenzotriazoles such as butylcarboimidebenzotriazole; nitrobenzotriazoles as disclosed in Japanese Patent Application Kokai No. 58-118639; sulfobenzotriazoles as disclosed in Japanese Patent Application Kokai No. 58-118638; carboxybenzotriazole and its salt or hydroxybenzotriazole; 1,2,4-triazoles and 1H-tetrazoles as disclosed in U.S. Pat. No. 4,220,709; carbazoles, saccharin, imidazole and their derivatives.

Also usable in the pratice of the present invention are those silver salts described in *Research Disclosure,* No. 17029 (June 1978), organic metal salts other than silver salts such as copper stearate, and the silver salts of alkyl-containing carboxylic acids disclosed in Japanese Patent Application No. 58-221535, such as phenylpropiolic acid.

These organic silver salts may be used in amounts of from 0.01 to 10 moles, preferably from 0.01 to 1 mole per mole of the photosensitive silver halide. The combined amount of the photosensitive silver halide and the organic silver salt coated suitably ranges from about 50 $mg/m^2$ to 10 $g/m^2$.

A reducing agent may desirably be used in the light-sensitive material of the present invention. The reducing agents used herein include well-known reducing agents and the above-mentioned dye-providing substances having reducing nature. Also included are reducing agent precursors which themselves have no reducing nature, but exhibit reducing nature under the action of a nucleophilic agent or heat during the development process.

Examples of the reducing agents used herein include inorganic reducing agents such as sodium sulfite and sodium hydrogen sulfite, benzene sulfinic acids, hydroxylamines, hydrazines, hydrazides, borane-amine complexes, hydroquinones, aminophenols, catechols, p-phenylenediamines, 3-pyrazolidonones, hydroxytetronic acids, ascorbic acids, 4-amino-5-pyrazolones, etc. and the reducing agents described in T. H. James, "The Theory of the Photographic Process", the Fourth Edition, pages 291–334. Also usable are reducing agent precursors as disclosed in Japanese Patent Application Laid-Open Nos. 56-138736 and 57-40245, U.S. Pat. No. 4,330,617, and the like.

Various combinations of developing agents as described in U.S. Pat. No. 3,039,869 may also be used.

In the practice of the present invention, the reducing agent may be added in amounts of from 0.01 to 20 moles, preferably from 0.1 to 10 moles per mole of silver.

In the practice of the present invention, an image formation promoter may also be used. The image formation promotors have the functions of promoting such reaction as redox reaction of a silver salt-oxidizing agent with a reducing agent, formation of a dye from a dye-providing substance, decomposition of a dye or release of a mobile dye, and promoting transfer of a dye from a light-sensitive material to a dye-fixing layer. From their physical-chemistry, they may be classified into bases, base precursors, nucleophilic compounds, oils, thermal solvents, surface-active agents, and compounds capable of interacting with silver or silver ion. It should be noted that these compounds generally have multiple functions and thus possess some of the above-mentioned promoting effects combined.

The image formation promotors are illustrated for each of functional classes. However, this classification is made for convenience of description and actually, one compound often possesses more than one function in combination.

(a) Bases

Preferred examples of the bases include (1) inorganic bases, for example, hydroxides, secondary and tertiary phosphates, borates, carbonates, quinolinates, and metaborates of alkali metals and alkaline earth metals; quaternary alkyl ammonium hydroxides; and other metal hydroxides; and (2) organic bases, for example, aliphatic amines such as trialkyl amines, hydroxylamines, and aliphatic polyamines; aromatic amines such as N-alkyl-substituted aromatic amines, N-hydroxylalkyl-substituted aromatic amines and bis[p-(dialkylamino)phenyl]methanes; heterocyclic amines, amidines; cyclic amidines; guanidines; and cyclic guanidines. The particularly preferred bases are those having a pKa value of 8 or higher.

(b) Base precursors

Base precursors are preferably those precursors which undergo any reaction under heat to release a base, for example, organic acid-base salts which are decomposed or decarbonated upon heating, and compounds which are decomposed to release amines through such reactions as intramolecular nucleophilic substituting reaction, Lossen rearrangement, Beckman rearrangement, etc. The preferred base precursors include salts of trichloroacetic acid as described in U.K. Pat. No. 998,949; salts of alpha-sulfonylacetic acid as described in U.S. Pat. No. 4,060,420; salts of propiolic acid as described in Japanese Patent Application No. 58-55700; 2-carboxylcarboxamide derivatives as described in U.S. Pat. No. 4,088,496; salts of thermally decomposable acids with a basic component containing an organic base and an alkali metal or alkaline earth metal as described in Japanese Patent Application No. 58-69597; hydroxamcarbamates utilizing Lossen rearrangement as described in Japanese Patent Application No. 58-43860; and aldoximcarbamates capable of forming nitriles upon heating as described in Japanese Patent Application No. 58-31614. In addition, base precursors as disclosed in U.K. Pat. Nos. 998,945 and 2,079,480; U.S. Pat. No. 3,220,846; and Japanese Patent Application Kokai No. 50-22625, etc. are also useful.

(c) Nucleophilic compounds

Exemplary of the nucleophilic compounds there may be given water, water-releasing compounds, amines, amidines, guanidines, hydroxylamines, hydrazines, hydrazides, oximes, hydroxamic acid derivatives, sulfonamides, active methylene compounds, alcohols, and thiols, as well as salts and precursors of these compounds.

(d) Oils

Useful are those high-boiling organic solvents which are used as a solvent in emulsion dispersing a hydrophobic compound and also known as plasticizers.

(e) Thermal solvents

The thermal solvents are those compounds which are solid at an ambient temperature, but melts at elevated temperatures to serve as solvents. Useful are ureas, urethanes, amides, pyridines, sulfonamides, sulfones, sulfoxides, esters, ketones, and ethers, provided that they are solid at temperatures of lower than 40° C.

(f) Surface-active agents

Typical surface-active agents are pyridinium salts, ammonium salts, and phosphonium salts as disclosed in Japanese Patent Application Kokai No. 59-74547, and polyalkylene oxides as disclosed in Japanese Patent Application Kokai No. 59-57231.

(g) Compounds capable of interacting with silver or silver ion

Useful are imides, nitrogen-containing heterocyclic compounds as disclosed in Japanese Patent Application No. 58-51657, thiols as disclosed in Japanese Patent Application No. 57-222247, thioureas, and thioethers.

These images formation promotors may be incorporated in the light-sensitive material and/or the dye-fixing material. The particular layer into which the image formation promotors are incorporated may be any of the emulsion layer, intermediate layer, protective layer, dye-fixing layer, and layers adjoining any of these layers. The same applies to an embodiment where both the light-sensitive layer and the dye-fixing layer are on a common support.

The image formation promotors may be used alone or in admixture of two or more. Generally, the promoting effect is enhanced by the use of more than one promotor. An outstanding promoting effect is obtained particularly when the base or base precursor is combined with another promotor.

In the practice of the present invention, a variety of development inhibitors may be used for the purpose of obtaining a consistent image irrespective of variations in treating temperature and time during heat development. By the development inhibitor is meant those compounds capable of, immediately after development has proceeded to an optimum extent, neutralizing or reacting with a base to reduce its concentration in the film to inhibit development, or those compounds capable of, immediately after optimum development, interacting with silver or silver salt to retard development. Illustrative examples are acid precursors capable of releasing acid upon heating, electrophilic compounds capable of substitution reaction with a coexisting base upon heating, nitrogen-containing heterocyclic compounds, mercapto compounds, and the like. Specific examples of the acid precursors are oxime esters as disclosed in Japanese Patent Application Nos. 58-216928 and 59-48305, and those compounds capable of releasing an acid through Lossen rearrangement as disclosed in Japanese Patent Application No. 59-85834. Specific examples of the electrophilic compounds capable of substitution reaction with a base upon heating are such compounds as disclosed in Japanese Patent Application No. 59-85836, etc. The effect of these development inhibitors is enhanced particularly when they are combined with base precursors. The proportion of the base precursor to the acid precursor used herein may preferably range from 1/20 to 20/1, and more preferably, from 1/5 to 5/1 in molar ratio.

Further, in the present invention, it is possible to use a compound which activates development simultaneously with stabilizing the image. Particularly preferred compounds used herein are isothiuroniums including 2-hydroxyethylisothiuronium trichloroacetate as described in U.S. Pat. No. 3,301,678; bisisothiuroniums including 1,8-(3,6-dioxaoctane)-bis(isothiuronium trifluroacetate) as described in U.S. Pat. No. 3,669,670; thiol compounds as described in German Patent Application (OLS) No. 2,162,714; thiazolium compounds such as 2-amino-2-thiazolium trichloroacetate, 2-amino-5-bromoethyl-2-thiazolium trichloroacetate, etc., as described in U.S. Pat. No. 4,012,260; compounds having alpha-sulfonylacetate as an acid part such as bis(2-amino-2-thiazolium)-methylene-bis(sulfonylacetate), 2-amino-2-thiazolium phenylsulfonylacetate, etc., as described in U.S. Pat. No. 4,060,420; and compounds having 2-carboxycarboxamide as an acid part as described in U.S. Pat. No. 4,088,496.

Also preferred are azolthio ethers and blocked azolinthione compounds as described in Belgian Pat. No. 768,071; 4-aryl-1-carbamyl-2-tetrazoline-2-thione compounds as described in U.S. Pat. No. 3,893,859; and those compounds described in U.S. Pat. Nos. 3,839,041; 3,844,788; and 3,877,940.

The photosensitive materials of the present invention may contain a toning agent if desired. Useful toning agents are 1,2,4-triazoles, 1H-tetrazoles, thiouracils, 1,3,4-thiadiazoles, and similar compounds. Examples of the preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above generally ranges from about 0.001 to 0.1 mole per mole of silver in the photosensitive material although the exact content depends upon the type of a heat developable photosensitive material used, processing conditions, desired images and various other factors.

In the practice of the present invention, the binders may be employed alone or in combinations thereof. A hydrophilic binder may be used as the preferred binder according to the present invention. The typical hydrophilic binder is a transparent or translucent hydrophilic binder, examples of which include natural substances, for example, proteins such as gelatin, gelatin derivatives and cellulose derivatives and polysaccharides such as starch, gum arabic, etc.; and synthetic polymers, for example, water-soluble polyvinyl compounds such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

The binder is coated in amounts of less than about 20 $g/m^2$, preferably less than about 10 $g/m^2$, and most preferably less than about 7 $g/m^2$. The high-boiling organic solvent may be dispersed in the binder together with the hydrophobic compound, for example, dye-providing substance such that the volume of the solvent is less than about 1 cc, preferably less than about 0.5 cc, and most preferably less than about 0.3 cc per gram of the binder.

In the photographic light-sensitive material and the dye-fixing material according to the present invention, the photographic emulsion layer and other binder layers may contain inorganic or organic hardeners. It is possible to use chromium salts such as chromium alum, chromium acetate, etc.; aldehydes such as formaldehyde, glyoxal, glutaraldehyde, etc.; N-methylol compounds such as dimethylolurea, methylol dimethylhydantoin, etc.; dioxane derivatives such as 2,3-dihydroxydioxane, etc.; active vinyl compounds such as 1,3,5-triacryloylhexahydro-s-triazine, 1,3-vinylsulfonyl-2-propanol, etc.; active halogen compounds such as 2,4-dichloro-6-hydroxy-s-triazine, etc.; mucohalogenic acids such as mucochloric acid, mucophenoxychloric acid, etc. or the like alone or in combinations of two or more.

The support used in the light-sensitive material of the present invention and the optional dye-fixing material must withstand the processing temperature. Exemplary of ordinary supports there may be given not only glass, paper, metal and analogues, but also an acetyl cellulose film, a cellulose ester film, a polyvinyl acetal film, a polystyrene film, a polycarbonate film, a polyethylene terephthalate film, and a film or plastic material related thereto. Further, a paper support laminated with a polymer such as polyethylene, etc. may be used. Those polyesters described in U.S. Pat. Nos. 3,634,089 and 3,725,070 are preferably used.

When a dye-providing substance which releases a mobile dye imagewise is used in the practice of the present invention, a dye transfer assistant may be used to transfer the dye from the light-sensitive layer to the dye-fixing layer. The dye transfer assistants of the type supplied from outside the system include water and aqueous alkaline solutions containing sodium hydroxide, potassium hydroxide, or inorganic alkali metal salts. Further, there may be used low boiling solvents such as methanol, N,N-dimethylformamide, acetone, diisobutyl ketone, etc., and mixtures of such a low boiling solvent with water or aqueous alkaline solution. The dye transfer assistant may be used by wetting the image receiving layer with the transfer assistant.

When the dye transfer assistant has been incorporated into the light-sensitive material or dye-fixing material, the transfer assistant need not be supplied from the outside. The above-described dye transfer assistant may be incorporated into the material in the form of water of crystallization or microcapsules or as a precursor which releases a solvent at elevated temperatures. More preferably, a hydrophilic thermal solvent which is solid at an ambient temperature and melts at a high temperature may be incorporated into the light-sensitive material or dye-fixing material. The hydrophilic thermal solvent may be incorporated in the light-sensitive material and/or the dye-fixing material. Although the solvent can be incorporated into any of the emulsion layer, intermediate layer, protective layer, and dye-fixing layer, it is preferred to incorporate it into the dye-fixing layer and/or layers adjacent thereto.

Examples of the hydrophilic thermal solvents include ureas, pyridines, amides, sulfonamides, imides, alcohols, oximes and other heterocyclic compounds.

When the dye-providing substance having general formula (C1) as defined above is contained in the light-sensitive material of the present invention, such additives as antiirradiation and antihalation substances and various dyes need not necessarily be contained in the light-sensitive material because of coloring of the dye-providing substance. For the purpose of improving the sharpness of an image, filter dyes, absorptive materials and the like may be contained as disclosed in Japanese Patent Publication No. 48-3692; U.S. Pat. Nos. 3,253,921; 2,527,583; and 2,956,879; etc. Preferred among these dyes are thermally decoloring dyes, for example, those disclosed in U.S. Pat. Nos. 3,769,019; 3,745,009; and 3,615,432.

The light-sensitive materials of the present invention may optionally contain any of a variety of additives well known for use in heat-developable light-sensitive materials and possess in addition to the light-sensitive layer, any layers including antistatic layer, electroconductive layer, protective layer, intermediate layer, AH layer, and peeling layer. Examples of the additives include such additives as disclosed in *Research Disclosure,* Vol. 170, July 1978, No. 17029, for example, plasticizers, sharpness improving dyes, AH dyes, sensitizing dyes, matte agents, surface-active agents, brightening agents, discoloration retarders, etc.

The photographic element according to the present invention includes a light-sensitive element which forms or release a dye upon heat development and optionally, a dye-fixing element which fixes the dye. Particularly systems of forming an image through diffusion transfer of a dye need the light-sensitive and dye-fixing elements as requisite elements. They are generally classified into two typical forms, one form having light-sensitive and dye-fixing elements separately applied on two separate supports and another form having both light-sensitive and dye-fixing elements applied on a common support.

The former system having light-sensitive and dye-fixing elements separately applied on two separate supports is generally sub-classified into two types, peeling type and non-peel type. In the case of peeling type, the coated surface of the light-sensitive element is overlapped the coated surface of the dye-fixing element after imagewise exposure or heat development, and the light-sensitive element is separated from the dye-fixing element immediately after formation of a transfer image. Depending on whether the final image is of reflective or transmissive type, the suport of the dye-fixing element may be selected among opaque or transparent supports. If desired, a white reflective layer may be applied. In the case of non-peel type, a white reflective layer must be interposed between the light-sensitive layer of the light-sensitive element and the dye-fixing layer of the dye-fixing element while the white reflective layer may be applied to either the light-sensitive element or the dye-fixing element. The support of the dye-fixing element must be a transparent support.

The latter system having both light-sensitive and dye-fixing elements applied on a common support is typically one wherein the light-sensitive element need not be peeled from the image-receiving element after formation of a transfer image. In this case, a light-sensitive layer, a dye-fixing layer, and a white reflective layer are laminated on a transparent or opaque support. The preferred arrangements are transparent or opaque support/light-sensitive layer/white reflective layer/dye-fixing layer and transparent support/dye-fixing layer/white reflective layer/light-sensitive layer, to name a few.

Another typical form having both light-sensitive and dye-fixing elements applied on a common support is one wherein a separating layer is applied at a proper location such that the light-sensitive element may be entirely or partially separated from the dye-fixing element, as disclosed in Japanese Patent Application Kokai No. 56-67840, Canadian Pat. No. 674,082, and U.S. Pat. No. 3,730,718.

The light-sensitive or dye-fixing element may be one possessing an electroconductive heating element layer as heating means for heat development or diffusion transfer of a dye.

In order to provide a wide range of color within the chromaticity diagram using three primary colors, yellow, magenta and cyan, the photosensitive element used in the practice of the invention should include at least three silver halide emulsion layers having sensitivity in different spectra.

Typical combinations of at least three silver halide emulsion layers having sensitivity in different spectra are a combination of blue-sensitive emulsion layer/green-sensitive emulsion layer/red-sensitive emulsion layer, a combination of green-sensitive emulsion layer/red-sensitive emulsion layer/infrared-sensitive emulsion layer, a combination of a blue-sensitive emulsion layer/green-sensitive emulsion layer/infrared-sensitive emulsion layer, and a combination of blue-sensitive emulsion layer/red-sensitive emulsion layer/infrared-sensitive emulsion layer. By the infrared-sensitive emulsion layer used herein it is meant that the emulsion layer is sensitive to light having a wavelength of more than 700 nm, particularly more than 740 nm.

The photosensitive materials of the present invention may have two or more emulsion layers having sensitivity in the same spectrum, but different in emulsion sensitivity.

Each of the above-mentioned emulsion layers and/or photo-insensitive hydrophilic colloid layer disposed adjacent thereto should contain either of a dye-providing substance which releases or forms a hydrophilic yellow dye, a dye-providing substance which releases or forms a hydrophilic magenta dye, and a dye-providing substance which releases or forms a hydrophilic cyan dye. Differently stated, each emulsion layer and/or a photo-insensitive hydrophilic colloid layer disposed adjacent thereto should contain a dye-providing substance which releases or forms a hydrophilic dye of different hue. If desired, mixtures of two or more dye-providing substances having the same hue may be used. When the dye-providing substance is originally colored, the dye-providing substance may advantageously be contained in a layer other than the emulsion layer. In addition to the above-mentioned layers, the photosensitive materials of the present invention may further include any auxiliary layer, for example, a protective layer, intermediate layer, antistatic layer, anti-curling layer, peeling layer, and matte agent layer.

More specifically, the protective layer or coat usually contains an organic or inorganic matte agent for adherence prevention. The protective layer may further contain a mordant, a UV-absorber, etc. Each of the protective and intermediate layers may be comprised of two or more layers.

The intermediate layer may contain a reducing agent, a UV absorber, and a white pigment (such as $TiO_2$) in order to prevent color mixing. The white pigment may be added not only to the intermediate layer, but also to the emulsion layers for the purpose of increasing sensitivity.

In order to impart the necessary color sensitivity to each silver halide emulsion layer, the silver halide emulsion may be sensitized with a well-known sensitizing dye to provide the desired spectral sensitivity.

The dye-fixing element used in the present invention has at least one layer containing a mordant. When the dye-fixing layer is positioned at the surface, a protective layer may further be applied thereon if necessary.

Further, in order that a dye transfer assistant may be contained in a sufficient amount or controlled, a water-absorbing layer or dye transfer assistant-containing layer may be provided. Such a layer may be applied contiguous to the dye-fixing layer or via an intermediate layer.

The dye-fixing layer used in the practice of the invention may be divided into two layers containing mordants having different mordanting power, if necessary.

The dye-fixing element used in the practice of the invention may include any auxiliary layer, for example, a peeling layer, matte agent layer, and anti-curling layer.

One or more of the above-mentioned layers may contain a base or base precursor for promoting dye transfer, hydrophilic thermal solvent, anti-discoloration agent for preventing discoloration of a dye, UV absorber, dispersed vinyl compound for increasing dimensional stability, and brightening agent.

The binders used in the above-mentioned layers are preferably hydrophilic, and typically transparent or translucent hydrophilic colloids. Exemplary of the hydrophilic binders there may be given natural substances, for example, proteins such as gelatin, gelatin derivatives, cellulose derivatives, etc, and polysaccharides such as starch, dextrin, pluran, gum arabic, etc., and synthetic polymers, for example, water-soluble polyvinyl compounds such as polyvinyl alcohol and polyvinyl pyrrolidone, acrylamide polymers, etc. Particularly useful among them are gelatin and polyvinyl alcohol.

The dye-fixing element may further include in addition to the above-mentioned layers, a reflective layer containing a white pigment like titanium oxide, neutralizing layer, neutralization timing layer or the like depending on the intended application. These layers may also be provided in the photosensitive element as well as in the dye-fixing element. The organization of these reflective, neutralizing, and neutralization timing layers is described, among others, in U.S. Pat. Nos. 2,983,606; 3,362,819; 3,362,821; and 3,415,644; and Canadian Pat. No. 928,559.

The dye-fixing element advantageously takes the form containing a transfer assistant as will be described later. The transfer assistant may be contained in either the dye-fixing layer or another layer.

When developing means used in connection with the present photosensitive material is electrical conduction heating, a transparent or opaque heating element may be prepared by a prior art technique well known for resistance heating elements. Such a resistance heating element may be prepared by utilizing a thin film of a semiconductive inorganic material or an organic thin film of conductive fine particles dispersed in a binder. The materials which can be used in the former include silicon carbide, molybdenum silicide, lanthanum chromate, barium titanate ceramics used in PTC thermistors, tin oxide, and zinc oxide, and they may be formed into a transparent or opaque thin film by a well-known method. In the latter case, a resistive body having the desired temperature properties is prepared by dispersing conductive fine particles such as metal fine particles, carbon black, graphite in rubber, synthetic polymer or gelatin. The resistive body may be in direct contact with the photosensitive element or spaced therefrom through the support, intermediate layer or the like.

Some illustrative arrangements of the heating element and the photosensitive element are shown below.

Heating element/support/photosensitive element,
Support/heating element/photosensitive element,
Support/heating element/intermediate layer/photosensitive element,
Support/photosensitive element/heating element,
Support/photosensitive element/intermediate layer/-heating element.

The image-receiving layer used in the practice of the present invention is a dye-fixing layer used in usual heat-developable color photosensitive materials, and the mordants contained therein may be selected from commonly used mordants, with polymeric mordants being particularly preferred. The polymeric mordants include polymers containing a tertiary amino group, polymers having a nitrogen-containing heterocyclic moiety, and polymers containing a quaternary cationic group.

Those polymers containing vinyl monomer units having a tertiary amino group are described in Japanese Patent Application Nos. 58-169012 and 58-166135. Those polymers containing vinyl monomer units having a tertiary imidazole group are described in Japanese Patent Application Nos. 58-226496 and 58-232071; U.S. Pat. Nos. 4,282,305; 4,115,124; and 3,148,061. Those polymers containing vinyl monomer units having a quaternary imidazolium salt are described in U.K. Pat. Nos. 2,056,101; 2,093,041; and 1,594,961; U.S. Pat. Nos. 4,124,386; 4,115,124; 4,273,853; and 4,450,224; and Japanese Patent Application Kokai No. 48-28225. Those polymers containing vinyl monomer units having a quaternary ammonium salt are described in U.S. Pat. Nos. 3,709,690; 3,898,088; and 3,958,995; Japanese Patent Application Nos. 58-166135, 58-169012, 58-232070, 58-232072, and 59-91620.

According to the present invention, the presence of a dye having general formula (I) offers an improved heat-developable color light-sensitive material which is prevented from reducing its sensitivity during shelf storage without sacrificing sensitivity and fogging.

EXAMPLES

In order that those skilled in the art may better understand how the present invention may be practiced, the following examples are given by way of illustration and not by way of limitation.

EXAMPLE 1

A silver benzotriazole emulsion was prepared as follows.

Preparation of Silver Benzotriazole Emulsion

Gelatin (28 g) and benzotriazole (13.2 g) were dissolved in water (3,000 ml). The resulting solution was agitated at 40° C. A solution of silver nitrate (17 g) in water (100 ml) was added to the solution over a period of 2 minutes.

The resulting benzotriazole silver emulsion was adjusted to such pH that an excess salt precipitated, and the excess salt was filtered off. The emulsion was then adjusted to pH 6.30, obtaining a silver benzotriazole emulsion in a yield of 400 g.

A silver halide emulsion was prepared as follows.

Preparation of Silver Halide Emulsion

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide and another aqueous solution of 0.59 moles of silver nitrate in 600 ml of water were concurrently added to the gelatin solution at an equal flow rate over a period of 40 minutes. In this way, there was prepared a monodispersed cubic silver chlorobromide emulsion having an average particle size of 0.35 μm (bromine 80 mol%).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

Next, a dispersion of a dye-providing substance in gelatin was prepared as follows.

Preparation of Gelatin Dispersion of Dye-Providing Substance

Five (5) grams of dye-providing material (A) having the following formula:

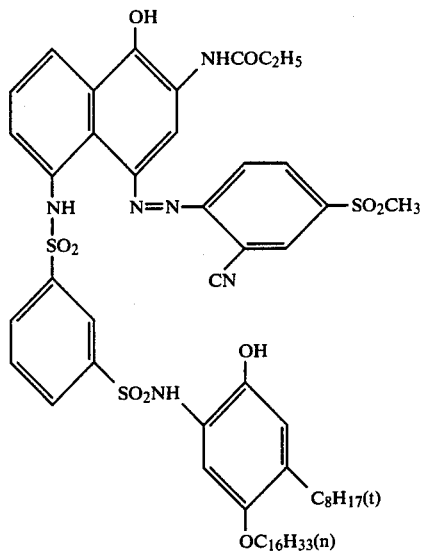

was dissolved together with 0.5 g of succinic acid-2-ethylhexyl ester sodium sulfonate and 10 g of triisononyl phosphate in 30 ml of ethyl acetate by heating at about 60° C., obtaining a homogeneous solution. The solution was mixed with 100 g of a 10 wt% solution of lime-treated gelatin by agitation, and the mixture was dispersed with a homogenizer for 10 minutes at 10,000 rpm. This dispersion is called cyan dye-providing substance dispersion.

Preparation of Light-Sensitive Coating Composition

A light-sensitive coating composition was prepared from the following formulation.

| Light-sensitive coating composition | | |
|---|---|---|
| (a) | Silver benzotriazole emulsion | 10 g |
| (b) | Light-sensitive silver chlorobromide emulsion | 15 g |
| (c) | Dye-providing substance dispersion | 25 g |
| (d) | Aqueous solution of 5 wt % compound having the formula: | ml |

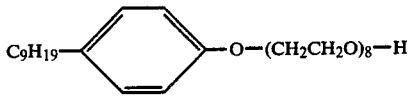

| | | |
|---|---|---|
| (e) | Methanol solution of 10% benzenesulfonamide | 5 ml |
| (f) | Aqueous solution of 10 wt % guanidine 4-methylsulfonylphenyl sulfonyl acetate | 15 ml |
| (g) | Methanol solution of 0.04% sensitizing dye (2) | 4.5 ml |

Components (a) to (g) were mixed, and a thickening agent (for example, sodium polystyrene-p-sulfonate) and water were added to a total volume of 100 ml. This coating solution was applied to a polyethylene terephthalate base film of 180 μm thick to a wet thickness of 50 μm and then dried to form a light-sensitive material.

Further, a protective coating composition was prepared as follows.

| Protective composition | | |
|---|---|---|
| (h) | 10% gelatin aqueous solution | 400 g |
| (i) | Aqueous solution of 10 wt % quanidine 4-methylsulfonylphenyl sulfonylacetate | 240 ml |
| (j) | Aqueous solution of 4% hardening | 50 ml |

-continued

| Protective composition |
|---|
| agent having the formula: $CH_2{=}CH{-}SO_2CH_2CONH{-}(CH_2)_2{-}NHCOCH_2SO_2CH{=}CH_2$ |

Components (h) to (j) were mixed, and a thickening agent and water were added to a total volume of 1000 ml. The resulting protective composition was applied to the light-sensitive coating to a wet thickness of 30 μm and then dried, producing light-sensitive material No. 101.

An additional light-sensitive material No. 201 was prepared by the same procedure as for light-sensitive material No. 101 except that sensitizing dye (a) having the following structural formula was used in lieu of sensitizing dye (2) as component (g) in the preparation of the light-sensitive coating composition.

Sensitizing dye (a)

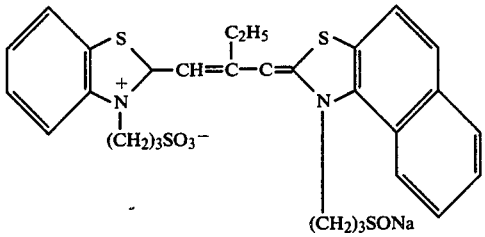

Each sample of the color light-sensitive materials as prepared above was imagewise exposed for one second at 2000 lux under a tungsten lamp through a SC-72 filter (Manufactured by Fuji Photo Film Company). Then, the sample was uniformly heated for 30 seconds on a heat block at 140° C.

Next, the preparation of a dye-fixing material will be described.

Preparation of Dye-Fixing Material

Ten grams of methyl acrylate-co-N,N,N-trimethyl-N-vinylbenzylammonium chloride copolymer (molar ratio of methyl acrylate to vinylbenzyl ammonium chloride 1:1) was dissolved in 200 ml of water, and the solution was homogeneously mixed with 100 g of 10 wt% lime-treated gelatin. The resulting mixture was uniformly spread onto a paper substrate laminated with polyethylene having titanium dioxide dispersed therein, thereby forming a dye-fixing layer having a uniform wet thickness of 90 μm. The layer was dried to provide a dye-fixing material having a mordant layer.

Water was applied in an amount of 20 ml per square meter to the sensitive surface of the dye-fixing material prepared above. The heated light-sensitive material was superimposed on the dye-fixing material such that their effective surfaces faced one another.

After heating on a heat block at 80° C. for 6 seconds, the dye-fixing material was peeled from the light-sensitive material. The dye-fixing material then bore thereon cyan color images. Density of the image was measured by means of a Macbeth (RD-519) reflection densitometer. Relative sensitivity (R.S.) and fogging were derived therefrom.

For those light-sensitive materials which had been shelf aged for 3 days at 40° C. and 80% RH, relative sensitivity and fogging were similarly determined.

Relative sensitivity is indicated as a relative value provided that the sensitivity of light-sensitive material No. 101 is 100 in fresh state, that is, just as prepared.

TABLE 1

| Light-sensitive material No. | Fresh R.S. | Fresh Fogging | Aged R.S. | Aged Fogging |
|---|---|---|---|---|
| 101 (invention) | 100 | 0.15 | 75 | 0.19 |
| 201 (comparison) | 120 | 0.14 | 5 | 0.17 |

As seen from the data in Table 1, the light-sensitive material of the present invention is not only prevented from reducing its sensitivity during shelf storage, but also has comparable sensitivity when fresh, i.e., immediately after preparation. Its fogging value is also at a satisfactory level both in fresh and aged states.

EXAMPLE 2

The procedure of Example 1 was repeated except that the sensitizing dyes listed in Table 2 were used.

Relative sensitivity (R.S.) was measured as defined in Example 1. The light-sensitive materials were aged for 3 days at a temperature of 40° C. and a relative humidity of 80%. The results are shown in Table 2.

TABLE 2

| Light-sensitive material No. | Sensitizing dye | Fresh R.S. | Fresh Fogging | Aged R.S. | Aged Fogging |
|---|---|---|---|---|---|
| 102 (invention) | (4) | 150 | 0.20 | 25 | 0.18 |
| 103 (invention) | (12) | 75 | 0.16 | 40 | 0.16 |
| 104 (invention) | (22) | 50 | 0.14 | 40 | 0.14 |
| 105 (invention) | (25) | 125 | 0.18 | 75 | 0.16 |
| 106 (invention) | (28) | 100 | 0.20 | 75 | 0.17 |
| 107 (invention) | (32) | 50 | 0.17 | 25 | 0.15 |
| 202 (comparison) | (b)* | 25 | 0.16 | 5 | 0.35 |

*(b)

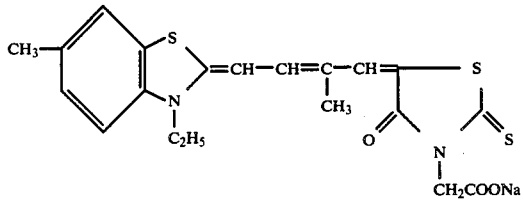

As seen from the data in Table 2, the light-sensitive material of the present invention is not only prevented from reducing its sensitivity during shelf storage, but also has comparable sensitivity when fresh, i.e., immediately after preparation. Its fogging value is also at a satisfactory level both in fresh and aged states.

EXAMPLE 3

This example illustrates the application of the present invention to a color light-sensitive material of multilayer structure.

The silver benzotriazole emulsion and the emulsion for the first layer were the same as used in Example 1.

An emulsion used in the third layer was prepared as follows.

Preparation of Third Layer Emulsion

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide, another aqueous solution of 0.59 moles of silver nitrate in 600 ml of water, and a dye solution (I)

as defined below were concurrently added to the gelatin solution at an equal flow rate over a period of 40 minutes. In this way, there was prepared a dye-adsorbed, monodispersed cubic silver chlorobromide emulsion having an average particle size of 0.35 μm (bromine 80 mol%).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

Dye solution (I)

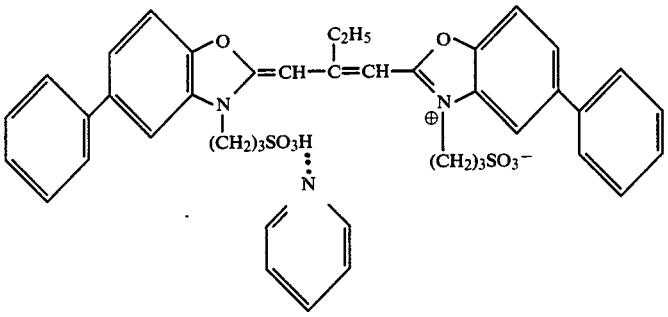

160 mg

Methanol 400 ml

A silver halide emulsion used in the fifth layer was prepared as follows.

Preparation of Fifth Layer Emulsion

An aqueous gelatin solution was prepared by dissolving 20 grams of gelatin and ammonia in 1000 ml of water and kept at a temperature of 50° C. To the fully agitated gelatin solution, 1000 ml of an aqueous solution of potassium iodide and potassium bromide and another aqueous solution of 1 mole of silver nitrate in 1000 ml of water were concurrently added while keeping a constant pAg. In this way, there was prepared a monodispersed octahedral silver iodobromide emulsion having an average particle size of 0.5 μm (bromine 5 mol%).

After rinsing with water and desalting, 5 mg of chloroauric acid (tetrahydrate) and 2 mg of sodium thiosulfate were added to effect gold and sulfur sensitization at 60° C. There was obtained an emulsion in a yield of 1.0 kg.

Dispersions of dye-providing substances in gelatin was prepared as follows.

Preparation of Gelatin Dispersion of Dye-Providing Substance

A dispersion of a cyan dye-providing substance was prepared from the cyan dye-providing substance (A) by the same procedure as in Example 1.

A dispersion of a magenta dye-providing substance was prepared by the same procedure as the preparation of the cyan dye-providing substance dispersion except that a magenta dye-providing substance (B) was used and 7.5 g of tricresyl phosphate was used as a high-boiling solvent.

Dye-providing substance (B)

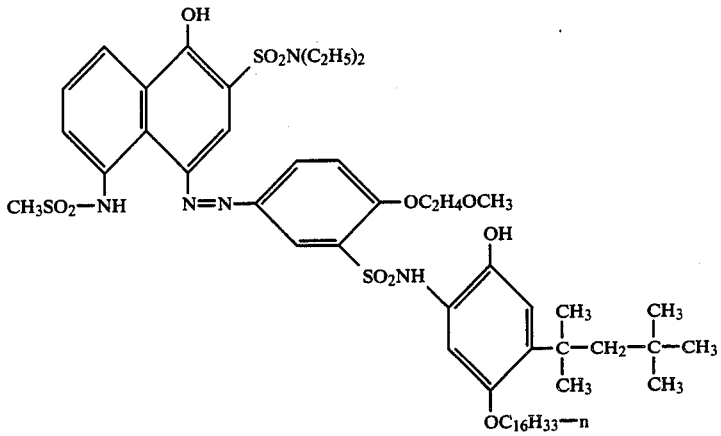

A dispersion of a yellow dye-providing substance was prepared by the same procedure as the preparation of the cyan dye-providing substance dispersion except that a yellow dye-providing substance (C) was used.

Dye-providing substance (C)

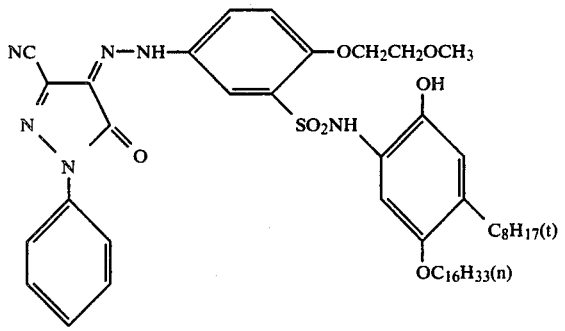

Using these emulsions, a number of color light-sensitive materials were prepared having the following formulation.

Sixth layer
- gelatin (coating weight 1000 mg/m$^2$)
- base precursor*3 (coating weight 600 mg/cm$^2$)

Fifth layer: Blue-sensitive emulsion layer
- silver iodobromide emulsion (iodine 5 mol%, coating weight 400 mg/m$^2$ of Ag)
- dimethylsulfamide (coating weight 180 mg/m$^2$)
- silver benzotriazole emulsion (coating weight 100 mg/m$^2$ of Ag)
- base precursor*3 (coating weight 500 mg/m$^2$)
- yellow dye-providing substance (C) (coating weight 400 mg/m$^2$)
- gelatin (coating weight 1000 mg/m$^2$)
- high-boiling solvent*4 (coating weight 800 mg/m$^2$)
- surface-active agent*2 (coating weight 100 mg/m$^2$)

Fourth layer: Intermediate layer
- gelatin (coating weight 1200 mg/m$^2$)
- base precursor*3 (coating weight 600 mg/m$^2$)

Third layer: Green-sensitive emulsion layer
- silver chlorobromide emulsion (bromide 80 mol%, coating weight 300 mg/m$^2$ of Ag)
- dimethylsulfamide (coating weight 180 mg/m$^2$)
- silver benzotriazole emulsion (coating weight 100 mg/m$^2$ of Ag)
- base precursor*3 (coating weight 500 mg/m$^2$)
- magenta dye-providing substance (B) (coating weight 400 mg/m$^2$)
- gelatin (coating weight 1000 mg/m$^2$)
- high-boiling solvent*1 (coating weight 600 mg/m$^2$)
- surface-active agent*2 (coating weight 100 mg/m$^2$)

Second layer: Intermediate layer
- gelatin (coating weight 1000 mg/m$^2$)
- base precursor*3 (coating weight 600 mg/m$^2$)

First layer: Red-sensitive emulsion layer
- silver chlorobromide emulsion (bromine 80 mol%, coating weight 300 mg/m$^2$ of Ag)
- benzenefulfonamide (coating weight 180 mg/m$^2$)
- silver benzotriazole emulsion (coating weight 100 mg/m$^2$ of Ag)
- sensitizing dye (coating weight $8\times10^{-7}$ mol/m$^2$)
- base precursor*3 (coating weight 500 mg/m$^2$)
- cyan dye-providing substance (A) (coating weight 300 mg/m$^2$)
- gelatin (coating weight 1000 mg/m$^2$)
- high-boiling solvent*4 (coating weight 450 mg/m$^2$)
- surface-active agent*2 (coating weight 100 mg/m$^2$)

Support

*1 tricresyl phosphate

*3 guanidine 4-methylsulfonylphenyl sulfonyl acetic acid

*2

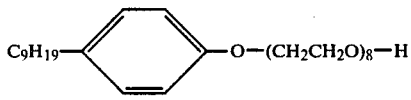

*4 (iso—$C_9H_{19}O)_3P{=}O$

Light-sensitive materials containing Compound (2) of the present invention and Compound (a) as the sensitizing dye in the first layer are designated light-sensitive materials 301 and 401, respectively.

Each sample of the color light-sensitive materials of multilayer structure was exposed for one second to 2000 lux under a tungsten lamp through three color separation filters B, G, and R having a continuously varying density. Then, the sample was uniformly heated for 30 seconds on a heat block at 150° C.

Water was applied in an amount of 20 ml per square meter to the sensitive surface of a dye-fixing material prepared in the same manner as in Example 1. The heated light-sensitive material was superimposed on the dye-fixing material such that their sensitive surfaces faced one another.

After heating on a heat block at 80° C. for 6 seconds, the dye-fixing material was peeled from the light-sensitive material. The dye-fixing material then bore thereon color images of yellow, magenta, and cyan corresponding to the B, G, and R three color separation filters.

For the cyan image to which our attention was drawn, sensitivity and fogging were examined both in fresh state and after aging for 3 days at 40° C. and 80% RH.

The results are shown in Table 3

TABLE 3

| Light-sensitive | Fresh | | Aged | |
|---|---|---|---|---|
| material No. | R.S.* | Fogging | R.S.* | Fogging |
| 301 (invention) | 100 | 0.15 | 75 | 0.19 |
| 401 (comparison) | 110 | 0.14 | 5 | 0.17 |

*Relative sensitivity is indicated as a relative value provided that the sensitivity of fresh light-sensitive material No. 301 is 100.

As seen from the data in Table 3, the light-sensitive material of the present invention is not only prevented from reducing its sensitivity during shelf storage, but also has comparable sensitivity when fresh, i.e., immediately after preparation. Its fogging value is also at a satisfactory level both in fresh and aged states.

EXAMPLE 4

A silver iodobromide emulsion was prepared as follows.

Preparation of Silver Iodobromide Emulsion

In 3000 ml of water was dissolved 40 grams of gelatin and 26 grams of KBr. The solution was agitated at 50° C. A solution of 34 grams of silver nitrate in 200 ml of water was added to the KBr solution over a period of 10 minutes. To this solution, a solution of 1.75 grams of KI in 100 ml of water was added over a period of 2 minutes. The thus prepared silver idobromide emulsion was adjusted to such pH that an excess salt precipitated out of the emulsion, and the excess salt filtered off. The emulsion was then adjusted to pH 6.0 to obtain a silver iodobromide emulsion in a yield of 400 g.

A light-sensitive coating composition was prepared as follows. The magenta dye-providing substance dispersion used was prepared from the magenta dye-providing substance (B) by the same procedure as in Example 3.

| Light-sensitive coating composition | | |
|---|---|---|
| (3) | Silver iodobromide emulsion (as prepared above) | 25 g |
| (b) | Water | 4 ml |
| (c) | Methanol solution of 0.04% sensitizing dye (2) | 4 ml |
| (d) | Magenta dye-providing substance dispersion | 33 g |
| (e) | Aqueous solution of 5 wt % compound having the formula: | 5 ml |

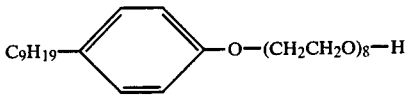

| | | |
|---|---|---|
| (f) | Ethanol solution of 10 wt % guanidine trichloroacetic acid | 12 ml |
| (g) | Aqueous solution of 10% dimethylsulfamide | 4 ml |

Components (a) to (g) were mixed to form a solution. This coating solution was applied to a polyethylene terephthalate base film to a wet thickness of 30 μm and then dried to form a light-sensitive material. Further, the following composition was applied thereon as a protective layer.

| Protective composition | | |
|---|---|---|
| (a) | 10% gelatin aqueous solution | 35 g |
| (b) | Ethanol solution of 10 wt % guanidine trichloroacetic acid | 5 ml |
| (c) | Aqueous solution of 1% 2-ethylhexyl succinate ester sodium sulfonate | 4 ml |
| (d) | Water | 56 ml |

Components (a) to (d) were mixed to form the protective composition which was applied to the light-sensitive coating to a wet thickness of 25 μm and then dried, producing light-sensitive material No. 501.

Two additional light-sensitive materials Nos. 502 and 601 were prepared by the same procedure as for light-sensitive material No. 501 except that sensitizing dye (32) of the present invention and sensitizing dye (a) were used in lieu of sensitizing dye (2) as component (c), respectively, in the preparation of the light-sensitive coating composition.

The subsequent procedure of Example 1 was repeated, obtaining magenta color images. Density of the image was measured by means of a Macbeth (RD-519) reflection densitometer. Relative sensitivity (R.S.) and fogging were derived therefrom.

For those light-sensitive materials which had been shelf aged for 10 days at 35° C. and 70% RH, relative sensitivity and fogging were similarly determined. The definition of relative sensitivity (R.S.) is set forth in Example 1.

The results are shown in Table 4.

TABLE 4

| Light-sensitive | Fresh | | Aged | |
|---|---|---|---|---|
| material No. | R.S. | Fogging | R.S. | Fogging |
| 501 (invention) | 200 | 0.12 | 175 | 0.15 |
| 502 (invention) | 180 | 0.14 | 160 | 0.15 |
| 601 (comparison) | 200 | 0.10 | 15 | 0.14 |

As seen from the data in Table 4, the light-sensitive material of the present invention is not only prevented from reducing its sensitivity during shelf storage, but also has comparable sensitivity when fresh, i.e., immediately after preparation. Its fogging value is also at a satisfactory level both in fresh and aged states.

What we claim is:

1. A heat-developable color light-sensitive material comprising on a support at least a light-sensitive silver halide emulsion, a binder, a compound which yields a mobile dye in direct or inverse proportion to the reaction of the light-sensitive silver halide being reduced into silver at elevated temperatures, and a spectral sensitizing dye having the general formula (I):

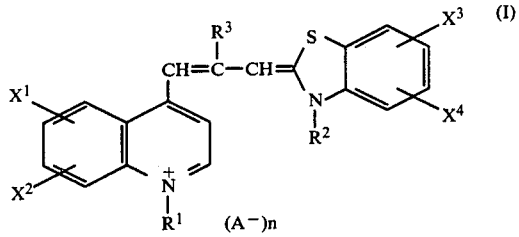

(I)

wherein $R^1$ and $R^2$ are independently selected from the group consisting of substituted or unsubstituted alkyl and alkenyl groups, $R^3$ is selected from the group consisting of hydrogen atom and substituted or unsubstituted alkyl, alkoxy, aryl and alkenyl groups, $X^1$, $X^2$, $X_3$, and $X^4$ are independently selected from the group consisting of a hydrogne atom, a halogen, a hydroxyl group, a carboxyl group and a substituted or unsubstituted alkyl group, an alkoxy group, an alkoxycarbonyl group, an acyl group, an acyloxyl group, an aryl group, an amino group, and an acylamino group, $X^1$ and $X^2$ and $X^3$ and $X_4$ can be mutually combined to form a benzene ring, $A^-$ is an anion, and n has a value equal to 0 or 1.

2. A heat-developable color light-sensitive material of claim 1 wherein $R^1$ and $R^2$ are independently selected from the group consisting of substituted or unsubstituted alkyl groups having 1 to 20 carbon atoms and substituted or unsubstituted alkenyl groups having 3 to 20 carbon atoms.

3. A heat-developable color light-sensitive material of claim 1 wherein $R^3$ is selected from the group consisting of hydrogen atom, substituted or unsubstituted alkyl groups having 1 to 20 carbon atoms, substituted or unsubstituted alkoxyl groups having 1 to 20 carbon atoms, substituted or unsubstituted aryl groups having 6 to 14 carbon atoms, and substituted or unsubstituted alkenyl groups having 3 to 20 carbon atoms.

4. A heat-developable color light-sensitive material of claim 1 wherein $X^1$, $X^2$, $X^3$ and $X^4$ are independently selected from the group consisting of hydrogen atom, halogen atoms, hydroxyl group, carboxyl group, substituted or unsubstituted alkyl groups having 1 to 20 carbon atoms, substituted or unsubstituted alkoxy groups having 1 to 20 carbon atoms, substituted or unsubstituted alkoxycarbonyl groups, acyl groups and acyloxyl groups, substituted or unsubstituted aryl groups having 6 to 14 carbon atoms, and substituted or unsubstituted amino groups and acylamino groups.

5. A heat-developable color light-sensitive material of claim 1 wherein the anions represented by $A^-$ are halogen ions, substituted arylsulfonate anions, thiocyanate anion, or perchlorate anion.

6. The heat-developable color light-sensitive material of claim 1, wherein the compound which produces or yields a mobile dye has the general formula:

$$(\text{Dye})\text{-}X_q\text{-}Y$$

wherein Dye represents a dye which has a diffusibility different from the compound represented by $(\text{Dye-X})_q\text{-}Y$ when it is released from the molecule of $(\text{Dye-X})_q\text{-}Y$;

q represents an integer of 1 or 2;

X represents a simple bond or a connecting group; and

Y represents a group which releases Dye in correspondence or counter-correspondence to light-sensitive silver salt having a latent image distributed imagewise, the diffusibility of Dye released being different from that of the compound represented by Dye-X-Y.

7. The heat-developable color light-sensitive material of claim 1, which further comprises a member selected from the group consisting of a base, a base precursor or a base and a base precursor.

* * * * *

UNITED STATES PATENT AND TRADEMARK OFFICE

CERTIFICATE OF CORRECTION

PATENT NO. : 4,677,051

DATED : June 30, 1987

INVENTOR(S) : KUBODERA et al

It is certified that error appears in the above-identified patent and that said Letters Patent is hereby corrected as shown below:

| | |
|---|---|
| COLUMN 1, LINE 48 | Delete "idid.," and insert --ibid.,--; |
| COLUMN 1, LINE 61 | Delete "diclosed" insert --disclosed--; |
| COLUMN 14, LINE 21 | Delete "relataed" insert --related--; |
| COLUMN 43, LINES 17-18 | Delete "for-mulation"; |
| COLUMN 43, LINE 21 | Delete "600 mg/cm$^2$)" insert --600 mg/m$^2$)--. |
| COLUMN 45 | "LIGHT-SENSITIVE COATING COMPOSITION" Chart Delete "(3)" insert --(a)--. |

Signed and Sealed this

Fourteenth Day of February, 1989

*Attest:*

DONALD J. QUIGG

*Attesting Officer*

*Commissioner of Patents and Trademarks*